US007593676B2

(12) United States Patent
Katoh

(10) Patent No.: US 7,593,676 B2
(45) Date of Patent: Sep. 22, 2009

(54) IMAGE-FORMING APPARATUS WITH IMPROVED INTERMEDIATE TRANSFER BODY

(75) Inventor: Seiichi Katoh, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 126 days.

(21) Appl. No.: 11/808,090

(22) Filed: Jun. 6, 2007

(65) Prior Publication Data

US 2008/0107457 A1 May 8, 2008

(30) Foreign Application Priority Data

Nov. 8, 2006 (JP) ..... 2006-302892

(51) Int. Cl.
*G03G 15/01* (2006.01)

(52) U.S. Cl. ..... 399/302; 430/125.32

(58) Field of Classification Search ..... 399/302, 399/308; 430/125.32
See application file for complete search history.

(56) References Cited

U.S. PATENT DOCUMENTS 5,397,670 A * 3/1995 Tong et al. ..... 430/104
7,031,647 B2 * 4/2006 Mishra et al. ..... 399/302
7,130,569 B2 * 10/2006 Goodman et al. ..... 399/302
2007/0025740 A1 * 2/2007 Katoh et al. ..... 399/1

FOREIGN PATENT DOCUMENTS

JP 2001109277 A * 4/2001
JP A 2001-109277 4/2001
JP A 2003-226765 8/2003
JP A 2004-157474 6/2004
JP A 2005-194528 7/2005
JP A 2006-18273 1/2006

* cited by examiner

*Primary Examiner*—Robert Beatty
(74) *Attorney, Agent, or Firm*—Oliff & Berridge, PLC

(57) ABSTRACT

An image-forming apparatus including: an image holding member; a charging device that charges the image holding member; an electrostatic latent image-forming device that exposes a surface of the charged image holding member to light to form an electrostatic latent image; a developing device that develops the electrostatic latent image formed on the image holding member with toner into a toner image; an intermediate transfer body to which the toner image formed on the image holding member is transferred; a primary transfer device that transfers the toner image formed on the image holding member onto the intermediate transfer body; and a secondary transfer device that transfers the toner image transferred on the intermediate transfer body onto a recording medium, the intermediate transfer body including a resin layer containing polyaniline particles, and the 50 percentile particle diameter (number basis) of the toner being at least twice as large as the 50 percentile particle diameter (number basis) of the polyaniline particles.

12 Claims, 3 Drawing Sheets

IMAGE-FORMING APPARATUS WITH IMPROVED INTERMEDIATE TRANSFER BODY

CROSS-REFERENCE TO RELATED APPLICATIONS

This application is based on and claims priority under 35 USC 119 from Japanese Patent Application No. 2006-302892 filed Nov. 8, 2006.

BACKGROUND

1. Technical Field

The present invention relates to an image-forming apparatus.

2. Related Art

In image-forming apparatus utilizing electrophotographic processes, such as electrophotographic copying machines, laser printers, facsimile machines, or multifunctional OA processing machines, a visible toner image is formed by first uniformly forming a charge on an image holding member, which is a photoreceptor of an inorganic or organic material, then forming an electrostatic latent image thereon, with, for example, a laser beam obtained by a modulated image signal, and finally developing the electrostatic latent image with a charged toner. The toner image is then electrostatically transferred onto an image-receiving medium, such as recording paper, via an intermediate transfer body or directly, giving a desired reproduction of the image. Various image-forming apparatus have been proposed that use the above method of primary-transferring a toner image formed on an image holding member onto an intermediate transfer body, and then secondary-transferring the toner image from the intermediate transfer body to recording paper.

For example, in image-forming apparatus that use the above intermediate-transfer method, the intermediate transfer body is preferably a semiconductive endless belt. The term "semiconductive" means that the material in question has a volume resistivity of, for example, $10^7$ to $10^{13}$ Ωcm, and this definition shall apply hereinafter unless specified otherwise.

SUMMARY

According to an aspect of the present invention, there is provided an image-forming apparatus, comprising:

an image holding member;

a charging device that charges the image holding member;

an electrostatic latent image-forming device that exposes a surface of the charged image holding member to light to form an electrostatic latent image;

a developing device that develops the electrostatic latent image formed on the image holding member with toner into a toner image;

an intermediate transfer body to which the toner image formed on the image holding member is transferred;

a primary transfer device that transfers the toner image formed on the image holding member onto the intermediate transfer body; and a secondary transfer device that transfers the toner image transferred on the intermediate transfer body onto a recording medium, the intermediate transfer body comprising a resin layer containing polyaniline particles, and the 50 percentile particle diameter (number basis) of the toner being at least twice as large as the 50 percentile particle diameter (number basis) of the polyaniline particles.

BRIEF DESCRIPTION OF THE DRAWINGS

Exemplary embodiments of the present invention will be described in detail based on the following figures, wherein.

DETAILED DESCRIPTION

Hereinafter, exemplary embodiments of the present invention will be described with reference to drawings. In the Figures, the same codes are allocated to the units having essentially the same function in all drawings, and thus, duplicated description may be avoided.

Hereinafter, an example of the configuration of an image-forming apparatus according to an aspect of the invention having an intermediate transfer body of an aspect of the invention will be described in detail with reference to drawings.

Figure 1:
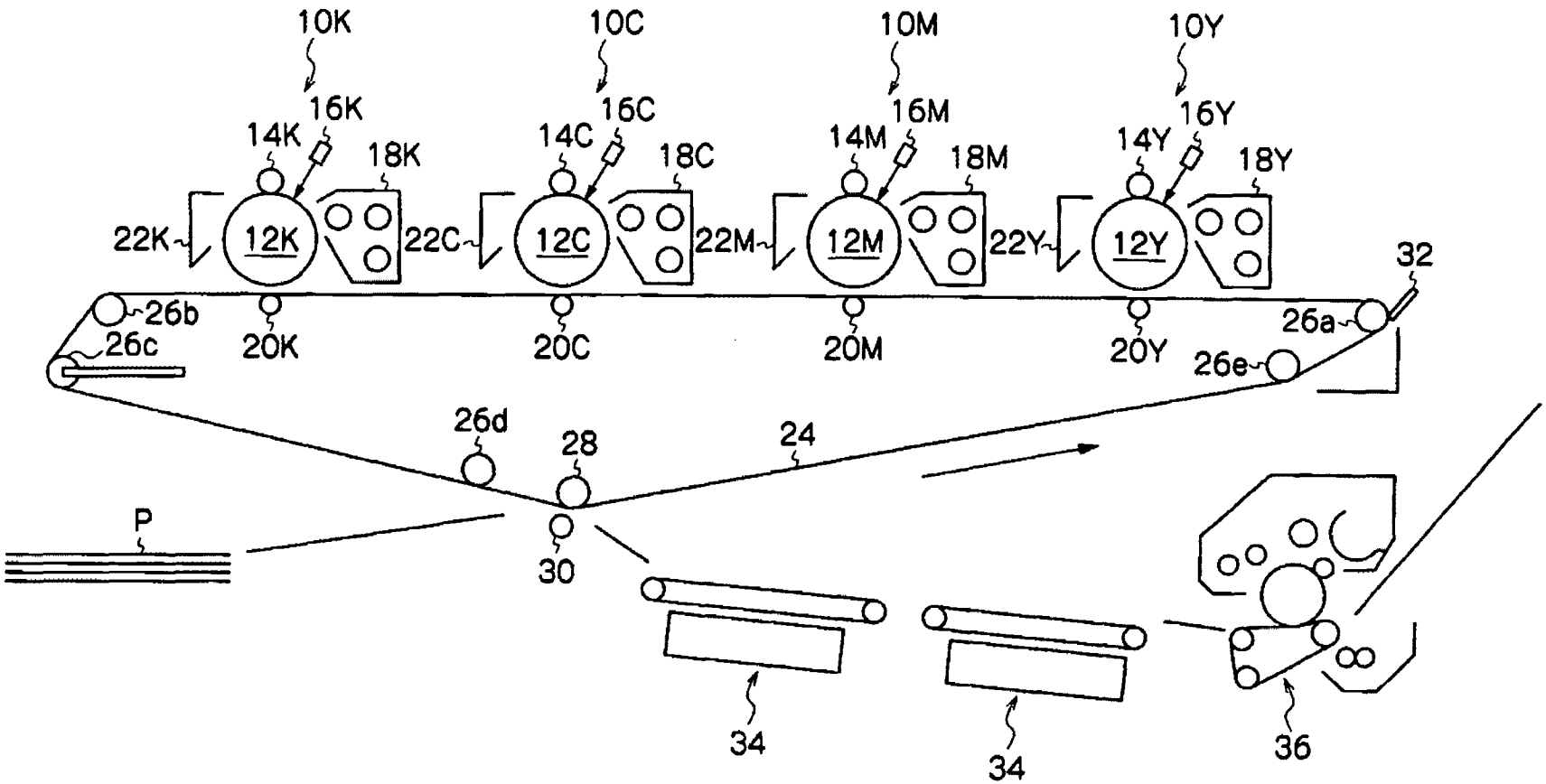
FIG. 1 is a schematic view illustrating the configuration of an exemplary embodiment of the image-forming apparatus.

FIG. 1 is a schematic view illustrating the configuration of the main area of an image-forming apparatus in an exemplary embodiment according to an aspect of the invention.

The image-forming apparatus in the exemplary embodiment is a high-speed multi-paper-output machine having four photoreceptor drums for different colors. As shown in FIG. 1, the image-forming apparatus in the exemplary embodiment has image-forming units 10Y, 10M, 10C, and 10K.

The image-forming units 10Y, 10M, 10C, and 10K include photoreceptor drums 12Y, 12M, 12C, and 12K (Y: yellow, M: magenta, C: cyan, and K: black) respectively as image-holding members, and further include at the periphery of the photoreceptor drums 12Y, 12M, 12C and 12K charging devices 14Y, 14M, 14C, and 14K that charge the surfaces of the photoreceptor drums 12Y, 12M, 12C, and 12K respectively; exposure devices 16Y, 16M, 16C, and 16K that form an electrostatic latent image on the surface of each of the charged photoreceptor drums 12Y, 12M, 12C, and 12K respectively; developing devices 18Y, 18M, 18C, and 18K that develop the electrostatic latent image formed on the surface of each of the photoreceptor drums 12Y, 12M, 12C, and 12K respectively into toner images using a toner contained in a developer; primary transfer devices 20Y, 20M, 20C, and 20K (for example, transfer rolls) that transfer the toner images onto an intermediate transfer belt 24; and photoreceptor drum cleaners 22Y, 22M, 22C, and 22K that remove toner remaining on the surface of the photoreceptor drums 12Y, 12M, 12C, and 12K after image transfer.

In addition, an intermediate transfer belt 24 is installed as an intermediate transfer body, as it faces the image-forming units 10Y, 10M, 10C, and 10K. The intermediate transfer belt 24 travels through the space between the photoreceptor drums 12Y, 12M, 12C, and 12K and the primary transfer devices (e.g., primary transfer rolls) 20Y, 20M, 20C, and 20K. The intermediate transfer belt 24 is held rotatably, as it is pushed outward by a drive roll 26*a*, a tension-steering roll 26*c* that prevents distortion or meandering of the intermediate transfer belt 24, supporting rolls 26*b*, 26*d* and 26*e*, and a backup roll 28.

A secondary transfer device 30 (e.g., secondary transfer roll) is installed on the periphery of the intermediate transfer belt 24 at a position facing the backup roll 28 via the intermediate transfer belt 24, and also, a belt cleaner 32, downstream of the secondary transfer device 30 in the intermediate transfer belt 24-revolving direction.

There are also installed a conveying device 34 that conveys the recording paper P (recording medium) carrying the image transferred at the secondary transfer device 30 and a fixing device 36 at a position downstream of the conveying device 34 in the conveying direction.

The configuration of the units other than the intermediate transfer belt (described below) may be the same as those of conventional units.

First in the image-forming apparatus in the exemplary embodiment, the photoreceptor drum 12Y in the image-forming unit 10Y revolves clockwise in the Figure, and the surface thereof is charged by the charging device 14Y. An electrostatic latent image in the first color (Y) is formed on the charged photoreceptor drum 12Y by an exposure devise 16Y such as laser-writing device.

The electrostatic latent image is developed with a toner (developer containing a toner) supplied by the developing device 18Y, to give a visualized toner image. The toner image advances to the temporary transfer region by rotation of the photoreceptor drum 12Y, where the toner image is primary-transferred onto the intermediate transfer belt 24 revolving counterclockwise, while an electric field in opposite polarity is applied from the primary transfer device 20Y to the toner image.

Similarly, a toner image (M) in the second color, a toner image (C) in the third color, and a toner image (K) in the fourth color are formed one by one by the image-forming units 10M, 10C, and 10K, and the toner images are superimposed on the intermediate transfer belt 24, forming a multicolor toner image.

Then, the multi-color toner image transferred on the intermediate transfer belt 24 advances to the secondary transfer region where the secondary transfer device 30 is placed, by rotation of the intermediate transfer belt 24.

In the secondary transfer region, the toner image is transferred onto a recording paper P by electrostatic repulsion, while a bias voltage (transfer voltage) in the same polarity with that of the toner image is applied between the secondary transfer device 30 and the backup roll 28 placed at the position facing it via the intermediate transfer belt 24.

The recording paper P is picked up one by one from the recording paper pile stored in a recording paper container (not shown in the Figure) by a pickup roller (not shown in the Figure), and fed into the space between the intermediate transfer belt 24 and the secondary transfer device 30 in the secondary transfer region at a particular timing by a feed roll (not shown in the Figure).

The toner image held on the intermediate transfer belt 24 is transferred onto the recording paper P supplied, by application of pressure and transfer voltage by the secondary transfer device 30 and the backup roll 28 and also by rotation of the intermediate transfer belt 24.

The recording paper P onto which the toner image has been transferred is fed into the fixing device 36 by the conveying device 34, where the toner image is fixed into a permanent image by application of pressure and heat.

The toner remaining on the intermediate transfer belt 24 after the multi-color toner image is transferred onto the recording paper P is removed by the belt cleaner 32 installed at a position downstream of the secondary transfer region, before entering into the next transferring cycle. In addition, foreign materials deposited during transfer such as toner particles and paper dust are removed by brush cleaning (not shown in the Figure) in the secondary transfer device 30.

In the case of a single-color image, a primary-transferred toner image in a single color is secondary-transferred and sent to the fixing device, but, in the case of a multicolor image in which multiple colors are superimposed, the rotation of the intermediate transfer belt 24 and the rotation of the photoreceptor drums 12Y, 12M, 12C, and 12K are synchronized to make the toner images superimposed accurately in the primary transfer region without any positional deviation.

In this way, an image is formed on the recording paper P (recording medium) in the image-forming apparatus in the exemplary embodiment.

In the image-forming apparatus in the exemplary embodiment described above, an intermediate transfer belt 24 having a resin layer containing polyaniline particles is used as the intermediate transfer body, and the 50 percentile particle diameter (number basis) of the toner is at least twice as large as the 50 percentile particle diameter (number basis) of the polyaniline particles.

Thus, there are polyaniline particles scattered on the surface of the intermediate transfer body, and microscopically; there is fluctuation in resistance along the surface and in the thickness direction; but, when the 50 percentile particle diameter (number basis) of the toner is at least twice as large as the 50 percentile particle diameter (number basis) of the polyaniline particles, there are more polyaniline particles in the region of the toner on the surface of the intermediate transfer body when the toner is deposited (retained) on the surface of the intermediate transfer body, possibly reducing the influence on the fluctuation of resistance in the surface and thickness directions by presence of the scattered polyaniline particles.

The 50 percentile particle diameter (number basis) of the toner is preferably at least three times, more preferably at least four times, as large as the 50 percentile particle diameter (number basis) of the polyaniline particles. The upper limit is determined by the 50 percentile particle diameter (number basis) of the toner, and, because the 50 percentile particle diameter (number basis) of the toner is preferably 8 μm or less, it is preferably 160 times or less, in view of the relationship with the favorable range of the 50 percentile particle diameter (number basis) of the polyaniline particles described below. It is because an excessively larger 50 percentile particle diameter (number basis) of the toner may lead to easier deterioration in image definition.

The 10 percentile particle diameter (number basis) of the toner may be larger than the 90 percentile particle diameter (number basis) of the polyaniline particles. In this way, there are more polyaniline particles in the toner region on the intermediate transfer belt, and thus, it is possible to reduce the influence on the fluctuation of resistance in the surface and thickness directions by presence of the scattered polyaniline particles.

The difference between the 10 percentile particle diameter (number basis) of toner and the 90 percentile particle diameter (number basis) of polyaniline particles is preferably 0.3 μm or more, more preferably 1.0 μm or more, and still more preferably 2.0 μm or more.

Hereinafter, the method of determining the 50 percentile particle diameter and the 90 percentile particle diameter of polyaniline particles will be described. In the exemplary embodiment, the 50 percentile particle diameter and the 90 percentile particle diameter (number basis) of the polyaniline particles are those determined by using a sample obtained in the intermediate transfer body (cross section in the thickness direction).

First, TEM images at six visual fields, three positions in the thickness direction (surface-sided region, central region in the thickness direction, and rear face-sided region)$_x$ two positions in the width direction, are obtained at an accelerating voltage of 100 KV and a magnification of 35,000, by using a section obtained similarly to the measurement of the absolute maximum length of the largest polyaniline particle described below.

Then, the TEM image of a resin (e.g., polyimide resin) and polyaniline particles obtained at a magnification of 35,000 is subjected to particle analysis by using an image analyzer Image Pro Plus manufactured by Media Cybernetics, Inc. (U.S.). The TEM image is adjusted to brightness and contrast suitable for measurement, and the image is shading-corrected if it has color tone gradient. When the test sample contains other substances such as filler in addition to the polyaniline particles, the image thereof is previously removed by image processing by using image density. The particle diameter (elliptical major axis) of the polyaniline particle is determined from each image in visual field. The measurement is repeated with the images in six visual fields, and the particle size distribution (number basis) is obtained from the average of the total. The particle diameter is then measured, after polyaniline particles visible only incompletely at the edge of the image field are removed, multiple polyaniline particles connected to each others are separated, and polyaniline particles apparently split in the image are recombined as needed.

The sections used for measurement are prepared with stripes collected as described above at three positions in the width direction and three positions in the peripheral direction on the intermediate transfer body. The nine sections are subjected to the measurement above, and the average obtained is designated as the particle size distribution (number basis) of the polyaniline particles of the intermediate transfer body. Specifically, a number basis cumulative distribution curve is plotted from the smallest side, and the particle diameter at a cumulative number of 10% is designated as 10 percentile particle diameter (number basis). Similarly, the particle diameter at a cumulative number of 50% is designated as 50 percentile particle diameter (number basis). Similarly, the particle diameter at a cumulative number of 90% is designated as 90 percentile particle diameter (number basis).

Hereinafter, the method of determining the 50 percentile particle diameter and the 10 percentile particle diameter of the toner will be described. First, the diameter of a particle is measured by using COULTER MULTISIZER II (manufactured by Beckmann Coulter) as the analyzer and ISOTON-II (manufactured by Beckmann Coulter) as the electrolyte solution.

In measurement, 0.5 to 50 mg of a measurement sample is added to 2 ml of a surfactant, preferably aqueous 5% sodium alkylbenzenesulfonate solution, as the dispersant, and the mixture is added to 100 to 150 ml of the electrolyte solution. The electrolyte solution containing the suspended measurement sample was dispersed in an ultrasonic homogenizer for approximately 1 minute, and the particle size distribution of the particles having a particle diameter in the range of 2.0 to 60 μm was determined in the COULTER MULTISIZER II by using an aperture having an aperture diameter of 100 μm. The number of the particles measured is 50,000.

From the data thus obtained, a number basis cumulative distribution curve is plotted from the smallest diameter with respect to divided particle size ranges (channels), and the particle diameter at a cumulative number of 10% is designated as 10 percentile particle diameter (number basis). Similarly, the particle diameter at a cumulative number of 50% is designated as 50 percentile particle diameter (number basis). Similarly, the particle diameter at a cumulative number of 90% is designated as 90 percentile particle diameter (number basis).

Hereinafter, the configuration of the intermediate transfer body will be described. Hereinafter, it will be described without numerical codes.

An intermediate transfer body having a resin layer containing polyaniline particles is used as the intermediate transfer body. The resin layer may be formed as the external surface layer (outermost layer), and, for example, the intermediate transfer body may be a single resin layer containing polyaniline particles or the intermediate transfer body may be a laminate of a base material and a resin layer containing polyaniline particles formed additionally on its peripheral surface. Hereinafter, an intermediate transfer body of a single resin layer containing polyaniline particles will be described as an example.

In the intermediate transfer body, the absolute maximum length of the maximum particle in polyaniline particles may be 10.0 μm or less. Hereinafter in the present specification, the largest particle in polyaniline particles will be called the "largest polyaniline particle".

When the longest particle among the particles of polyaniline contained in the resin (polyaniline particles) is designated as the largest polyaniline particle, the absolute maximum length in the phrase "the absolute maximum length of the maximum particle in polyaniline particles (largest polyaniline particle)" is the distance between the terminal two points most separated from each other on the largest polyaniline particle.

Thus, the largest polyaniline particle is the longest particle among the polyaniline particles (including gel, agglomerate and others) found in the intermediate transfer body.

The absolute maximum length of the largest polyaniline particle may be 10.0 μm or less, preferably 8.0 μm or less and more preferably 7.0 μm or less.

The absolute maximum length of the largest polyaniline particle is determined by staining the cross section of a sample cut off from an intermediate transfer body by electron-beam irradiation, incorporating optical images of the polyaniline particles therein under a transmission electron microscope (hereinafter, referred to as TEM), processing the images, and measuring the maximum length between two outer edges in the largest polyaniline particle.

The method of determining the absolute maximum length of the largest polyaniline particle used in an aspect of the invention will be described below in detail.

First, a rectangular sample of 1 mm×8 mm in size is cut off from an intermediate transfer body (the short side represents the side to be observed or the machine direction during molding). The sample is subjected to metal vapor deposition on one face for differentiation of the top and bottom surfaces of sample, and the sample is then embedded in an epoxy resin. After hardening, a thin section having a thickness of approximately 0.1 μm is prepared by using a microtome with a diamond knife. The microtome used is, for example, ULTRA CUT N manufactured by Reichert. If there is no polyaniline visible in the section obtained, the polyaniline is visualized by electron beam staining. The staining agent is selected, for example, from osmium tetroxide, ruthenium tetroxide, phosphotungstic acid, and iodine, properly considering the staining condition and others.

Images of six visual fields (three in the thickness direction× two in width direction) per 1 section are obtained under a transmission electron microscope (TEM: TECNAI G2 manufactured by FEI) under the condition of an accelerating voltage of 100 KV and a magnification of 12,000 times.

Then, the particles in each of the TEM images at a magnification of 12,000 thus obtained are analyzed by using an image analyzer IMAGE PRO PLUS manufactured by Media Cybernetics (U.S.). The TEM image is adjusted to brightness and contrast suitable for measurement, and the image is shading-corrected if it has color tone gradient. If a filler and/or others are contained in the sample in addition to the polyaniline particles, they are removed previously by processing the image while modifying the density of the particles. Some polyaniline particles relatively larger in each visual field are chosen, and the maximum length between two outer edges of each of the polyaniline particles is determined. The measurement of image is repeated in six visual fields, and the maximum length among those in the images in the six visual fields is designated as the absolute maximum length of the largest polyaniline particle in the sample (polyaniline particles overlapping or in contact with each other in the image are regarded as one polyaniline particle, and the absolute maximum length thereof is measured).

The sections for measurement were prepared from the rectangular samples cut off from an intermediate transfer body at a total of nine points, 3 points in the width direction×3 points in the length direction. The measurement was repeated for the samples from the nine points, and the maximum value observed is designated as the absolute maximum length of the largest polyaniline particle in the intermediate transfer body.

Preferably in the intermediate transfer body, the 50 percentile particle diameter (number basis) of the polyaniline particles is in the range of 0.05 to 3.0 μm, and the 90 percentile particle diameter (number basis) is equal to or greater than the 50 percentile particle diameter (number based) but not greater than twice the 50 percentile particle diameter (number basis).

Preferably, the 50 percentile particle diameter (number basis) is in the range of 0.05 to 2.00 μm and the 90 percentile particle diameter (number basis) is equal to or greater than the 50 percentile particle diameter (number based) but not greater than twice the 50 percentile particle diameter (number basis).

In an exemplary embodiment of the intermediate transfer body, the resin may further contain a dopant that makes the polyaniline conductive.

In another exemplary embodiment, the polyaniline in the intermediate transfer body may be a self-doped polyaniline. The self-doped polyaniline is a polyaniline that has a dopant structure in the molecule and has a self-doping function. There is no need for a dopant in the intermediate transfer body, if such a self-doped polyaniline is used.

The intermediate transfer body can be prepared by the following two production methods (methods of producing an intermediate transfer body).

[Preparation of Intermediate Transfer Body (1)]

Specifically, the intermediate transfer body is produced by pulverizing polyaniline in the undoped state, into particles having a 50 percentile particle diameter (volume basis) in the range of 0.05 to 3.0 μm and a 90 percentile particle diameter (volume basis) is equal to or greater than the 50 percentile particle diameter (volume basis) but not greater than twice the 50 percentile particle diameter (volume basis), adding a dopant to make the polyaniline particles conductive, mixing the particles with a polyamic acid, and drying and heating the resulting particles.

The "polyaniline in the undoped state (emeraldine base)" corresponds to the structure "B" among the possible four structures of polyaniline shown below. Typical examples thereof include those prepared by the method described in JP-A No. 8-259709, paragraph numbers [0042] to [0044] and the method of preparing polyaniline by solvent separation described in Research Report of Industrial Technology Center of Aichi Prefecture No. 37, and the like. The other examples include commercial products thereof such as "PANIPOL PA" manufactured by Panipol.

The number-average molecular weight of the polyaniline in the undoped state may be 4,000 to 400,000 for providing semiconductivity.

Possible Four Structures of Polyaniline Oxidized State

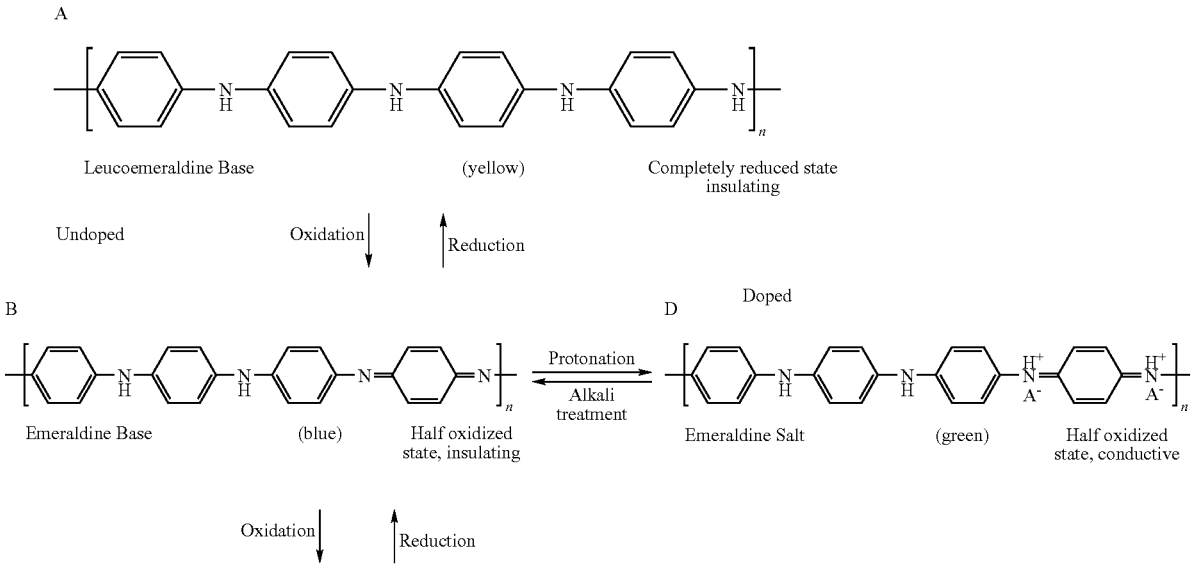

-continued

C

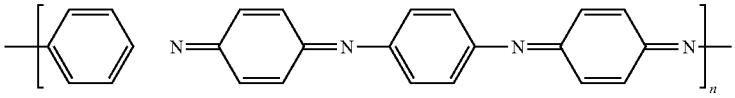

Pernigraniline Base (purpule) Complete oxidized state, insulating

Physical means such as pulverizer may be used for pulverization of the polyaniline in the undoped state, and both wet pulverization method and dry pulverization method are applicable.

Examples of the pulverizers for use include wet jet mill, dry jet mill, and the like. Generally, when the undoped polyaniline is granular or powdery in shape, pulverization in dry jet mill is better in processability than in wet jet mill, as it eliminates the need for substitution of the solvent after pulverization. On the other hand, when the polyaniline in the undoped state is pulverized in a wet jet mill, a poor solvent may be selected as the solvent in pulverization of the polyaniline in the undoped state, because DMAc (dimethylacetamide) or NMP (N-methyl-2-pyrrolidone) described below is a good solvent. Thus, the solvent should be replaced after pulverization.

The mechanical pulverization may be performed multiple times. For example, when the pulverization is performed twice in a wet jet mill, if the temperature of dispersion rises after the first pulverization, the next pulverization may be carried out after cooling. Cooling often leads to bedewing, and thus, the cooling then may be carried out in a low-temperature low-humidity environment at approximately 10° C. and 15% RH, for prevention of contamination of undesirable water.

When a wet method is used for pulverization of the undoped polyaniline, the liquid for use in dispersion of the polyaniline is, for example, ethanol, toluene, xylene, or the like.

The content of the undoped polyaniline in the dispersion may be in the range of 3 to 20 wt %, from the viewpoints of easiness of pulverization and control of particle size distribution. A higher content may lead to increase in viscosity of the dispersion, making pulverization more difficult.

The polyaniline may be pulverized until it satisfies the following conditions on particle size distribution: A 50 percentile particle diameter (volume basis) is in the range of 0.05 to 3.0 μm and a 90 percentile particle diameter (volume basis) is equal to or greater than the 50 percentile particle diameter (volume basis) but not greater than twice the 50 percentile particle diameter (volume basis); and more preferably, a 50 percentile particle diameter (volume basis) is in the range of 0.05 to 2.0 μm and a 90 percentile particle diameter (volume basis) is equal to or greater than the 50 percentile particle diameter (volume basis) but not greater than twice the 50 percentile particle diameter (volume basis).

In addition, the 100 percentile particle diameter (volume basis) may be approximately not greater than five times the 50 percentile particle diameter (volume basis), for prevention of contamination with abnormally bulky particles. The absolute maximum length of the largest polyaniline particle contained in the intermediate transfer belt can be reduced to 10.0 μm or less by pulverization of the particles to the particle diameter in the range above.

The particle size distribution is determined by using a laser diffraction/scattering particle-size-distribution analyzer (LA-700: manufactured by Horiba).

After completion of the polyaniline pulverization step, a dopant for making the polyaniline conductive is added to the dispersion.

The dopant for use may be, normally a protonic acid. Protonic acids favorable as the dopant are those having an acid dissociation constant pKa of 4.8 or less. Examples of the protonic acids include inorganic acids such as hydrochloric acid, sulfuric acid, nitric acid, phosphoric acid, fluoroboric acid, phosphofluoric acid, and perchloric acid, and organic acids having an acid dissociation constant pKa of 4.8 or less.

The organic acid is, for example, an organic carboxylic acid or a phenol, preferably that having an acid dissociation constant pKa of 4.8 or less. Examples of such organic acids include mono- or poly-basic aliphatic, aromatic, araliphatic, and alicyclic acids. Such an organic acid may have a hydroxyl group, a halogen atom, a nitro group, a cyano group, an amino group, or the like additionally; and typical examples of the organic acids include acetic acid, n-butyric acid, pentadecafluorooctanoic acid, pentafluoroacetic acid, trifluoroacetic acid, trichloroacetic acid, dichloroacetic acid, monofluoroacetic acid, monobromoacetic acid, monochloroacetic acid, cyanoacetic acid, acetylacetic acid, nitroacetic acid, triphenylacetic acid, formic acid, oxalic acid, benzoic acid, m-bromobenzoic acid, p-chlorobenzoic acid, m-chlorobenzoic acid, p-chlorobenzoic acid, o-nitrobenzoic acid, 2,4-dinitrobenzoic acid, 3,5-dinitrobenzoic acid, picric acid, o-chlorobenzoic acid, p-nitrobenzoic acid, m-nitrobenzoic acid, trimethylbenzoic acid, p-cyanobenzoic acid, m-cyanobenzoic acid, thymol blue, salicylic acid, 5-aminosalicyclic acid, o-methoxybenzoic acid, 1,6-dinitro-4-chlorophenol, 2,6-dinitrophenol, 2,4-dinitrophenol, p-oxybenzoic acid, bromophenol blue, mandelic acid, phthalic acid, isophthalic acid, maleic acid, fumaric acid, malonic acid, tartaric acid, citric acid, lacetic acid, succinic acid, α-alanine, β-alanine, glycine, glycolic acid, thioglycol acid, ethylenediamine-N,N'-diacetic acid, ethylenediamine-N,N,N',N'-tetraacetic acid, and the like.

Alternatively, the organic acid may contain a sulfonic or sulfuric acid group. Examples of the organic acids include aminonaphtholsulfonic acid, metanilic acid, sulfanilic acid, allylsulfonic acid, laurylsulfuric acid, xylenesulfonic acid, chlorobenzenesulfonic acid, methanesulfonic acid, ethanesulfonic acid, 1-propanesulfonic acid, 1-butanesulfonic acid, 1-hexanesulfonic acid, 1-heptanesulfonic acid, 1-octanesulfonic acid, 1-nonanesulfonic acid, 1-decanesulfonic acid, 1-dodecanesulfonic acid, benzenesulfonic acid, styrenesulfonic acid, p-toluenesulfonic acid, naphthalenesulfonic acid, ethylbenzenesulfonic acid, propylbenzenesulfonic acid, butylbenzenesulfonic acid, pentylbenzenesulfonic acid, hexylbenzenesulfonic acid, heptylbenzenesulfonic acid, octylbenzenesulfonic acid, nonylbenzenesulfonic acid, decylbenzenesulfonic acid, undecylbenzenesulfonic acid, dodecylbenzenesulfonic acid, pentadecylbenzenesulfonic acid, octadecylbenzenesulfonic acid, diethylbenzenesulfonic acid, dipropylbenzenesulfonic acid, dibutylbenzenesulfonic acid, methylnaphthalenesulfonic acid, ethylnaphthalenesulfonic acid, propylnaphthalenesulfonic acid, butylnaphthalenesulfonic acid, pentylnaphthalenesulfonic acid, hexylnaphthalenesulfonic acid, heptylnaphthalenesulfonic acid, octylnaphthalenesulfonic acid, nonylnaphthalenesulfonic acid, decylnaphthalenesulfonic acid, undecylnaphthalenesulfonic acid, dodecylnaphthalenesulfonic acid, pentadecylnaphthalenesulfonic acid, octadecylnaphthalenesulfonic acid, dimethylnaphthalenesulfonic acid, diethylnaphthalenesulfonic acid, dipropylnaphthalenesulfonic acid, dibutylnaphthalenesulfonic acid, dipentylnaphthalenesulfonic acid, dihexylnaphthalenesulfonic acid, diheptylnaphthalenesulfonic acid, dioctylnaphthalenesulfonic acid, dinonylnaphthalenesulfonic acid, trimethylnaphthalenesulfonic acid, triethylnaphthalenesulfonic acid, tripropylnaphthalenesulfonic acid, tributylnaphthalenesulfonic acid, camphorsulfonic acid, acrylamido-t-butylsulfonic acid, para-phenolsulfonic acid, and the like.

Alternatively, a multifunctional organic sulfonic acid having two or more sulfonic acid groups in the molecule may also be used. Examples of the multifunctional organic sulfonic acids include ethanedisulfonic acid, propanedisulfonic acid, butanedisulfonic acid, pentanedisulfonic acid, hexanedisulfonic acid, heptanedisulfonic acid, octanedisulfonic acid, nonanedisulfonic acid, decanedisulfonic acid, benzenedisulfonic acid, naphthalenedisulfonic acid, toluenedisulfonic acid, ethylbenzenedisulfonic acid, propylbenzenedisulfonic acid, butylbenzenedisulfonic acid, dimethylbenzenedisulfonic acid, diethylbenzenedisulfonic acid, dipropylbenzenedisulfonic acid, dibutylbenzenedisulfonic acid, methylnaphthalenedisulfonic acid, ethylnaphthalenedisulfonic acid, propylnaphthalenedisulfonic acid, butylnaphthalenedisulfonic acid, pentylnaphthalenedisulfonic acid, hexylnaphthalenedisulfonic acid, heptylnaphthalenedisulfonic acid, octylnaphthalenedisulfonic acid, nonylnaphthalenedisulfonic acid, dimethylnaphthalenedisulfonic acid, diethylnaphthalenedisulfonic acid, dipropylnaphthalenedisulfonic acid, dibutylnaphthalenedisulfonic acid, naphthalenetrisulfonic acid, naphthalenetetrasulfonic acid, anthracenedisulfonic acid, anthraquinonedisulfonic acid, phenanthrenedisulfonic acid, fluorenonedisulfonic acid, carbazoledisulfonic acid, diphenylmethanedisulfonic acid, biphenyldisulfonic acid, terphenyldisulfonic acid, terphenyltrisulfonic acid, naphthalenesulfonic acid-formalin condensates, phenanthrenesulfonic acid-formalin condensates, anthracenesulfonic acid-formalin condensates, fluorenesulfonic acid-formalin condensates, carbazolesulfonic acid-formalin condensates, and the like. The position of the sulfonic acid group in the aromatic rings may be any position.

Alternatively, the organic acid may be a polymer acid. Examples of the polymer acids include polyvinylsulfonic acid, polyvinylsulfuric acid, polystyrenesulfonic acid, sulfonated styrene-butadiene copolymers, polyallylsulfonic acid, polymethacrylsulfonic acid, poly-2-acrylamido-2-methylpropanesulfonic acid, poly-halogenated acrylic acids, polyisoprenesulfonic acid, N-sulfoalkylated polyanilines, ring-substituted polyanilines, and the like. A fluorine-containing polymer known as NAFION® (E.I. du Pont de Nemours and Company, U.S.) may also be used favorably as the polymer acid.

In addition, an ester from an organic acid and a polyhydroxy compound that has an acid terminal may be used as the organic acid. Examples of the polyhydroxy compounds include polyvalent alcohols such as ethylene glycol, propylene glycol, 1,3-propanediol, 1,4-butanediol, 1,3-butanediol, 1,5-pentanediol, neopentylglycol, 1,6-hexanediol, 1,4-bis(hydroxyethyl)cyclohexane, bisphenol A, hydrogenated bisphenol A's, hydroxypivalyl hydroxypivalate, trimethylolethane, trimethylolpropane, 2,2,4-trimethyl-1,3-pentanediol, glycerol, hexanetriol, tris(2-hydroxyethyl)isocyanurate, and pentaerythritol; polyether glycols such as polyoxyethylene glycol, polyoxypropylene glycol, polyoxyethylene tetramethylene glycol, polyoxypropylene tetramethylene glycol, and polyoxyethylene polyoxypropylene polyoxytetramethylene glycol; modified polyether polyols prepared by ring-opening polymerization of ethylene oxide, propylene oxide, tetrahydrofuran, ethylglycidylether, propylglycidylether, butylglycidylether, phenylglycidylether, allylglycidylether, or the like with a polyvalent alcohol; and the like.

Such a dopant makes the undoped polyaniline having the structure "B", one of the four possible structures of the polyaniline, conductive by protonation. Specifically, protonation of an imine nitrogen in quinonediimine in the structure "B" changes the molecule into the structure "D", making the undoped polyaniline conductive.

The term "conductive" means that the polyaniline has a volume resistivity, for example, of $10^7$ Ωcm or less. Hereinafter, the same shall apply, unless specified otherwise. Thus, the amount of the dopant used (addition amount) is determined according to the amount of quinonediimine structural units in the structure of the polyaniline in the undoped state. The dopant may be added as a solution as it is dissolved at a particular concentration.

As described above, after addition of a dopant, the dispersion is, for example, mixed additionally with a polyamic acid solution, giving a coating liquid.

The mixing in preparation of the coating liquid may be carried out using a mixing unit such as stirrer, sand-grind mill, attriter, or the like, but the mixing unit is not particularly limited, if the unit can mix the coating liquid to homogeneity.

The polyamic acid can be prepared as a solution, by dissolving an almost equimolar mixture of a tetracarboxylic dianhydride or the derivative thereof and a diamine in a polar organic solvent and allowing them to react with each other in the liquid state. An aromatic tetracarboxylic dianhydride may be used as the tetracarboxylic dianhydride, and an aromatic diamine may be used as the diamine; but other compounds may be used as needed.

Examples of the aromatic tetracarboxylic dianhydrides include pyromellitic dianhydride (PMDA), 3,3',4,4'-benzophenonetetracarboxylic dianhydride, 3,3'4,4'-biphenyltetracarboxylic dianhydride (BPDA), 2,3,3',4'-biphenyltetracarboxylic dianhydride, 2,3,6,7-naphthalenetetracarboxylic dianhydride, 1,2,5,6-naphthalenetetracarboxylic dianhydride, 1,4,5,8-naphthalenetetracarboxylic dianhydride, 2,2'-bis(3,4-dicarboxyphenyl)propane dianhydride, bis(3,4-dicarboxyphenyl)sulfone dianhydride, and the like. These anhydrides may be used alone or in combination of two or more.

Examples of the aromatic diamines include 4,4'-diaminodiphenylether (ODA), 4,4'-diaminodiphenylmethane, 3,3'-diaminodiphenylmethane, p-phenylenediamine, m-phenylenediamine, benzidine, 3,3'-dimethoxybenzidine, 4,4'-diaminodiphenylsulfone, 4,4'-diaminodiphenylsulfide, 4,4'-diaminodiphenylpropane, 2,2-bis[4-(4-aminophenoxy)phenyl]propane, and the like. These diamines may also be used alone or in combination of two or more.

Favorable combinations of the tetracarboxylic dianhydride and the aromatic diamine are 3,3',4,4'-biphenyltetracarboxylic dianhydride and 4,4'-diaminodiphenylether, 3,3',4,4'-biphenyltetracarboxylic dianhydride and 4,4'-diaminodiphenylether, and pyromellitic dianhydride and 4,4'-diaminodiphenylether, considering the moisture content, thermal expansion and surface micro-hardness of the resulting polyimide resin.

Examples of the solvents for use for the dopant and polyamic acid solutions described above include DMAc (dimethylacetamide), NMP (N-methyl-2-pyrrolidone), and the like.

A filler is preferably added to the coating liquid for improvement in the modulus of the intermediate transfer body and reduction of the expansion of the intermediate transfer body due to moisture content or heat.

Examples of the fillers include insulative fillers such as silica, alumina, mica, talc, whisker, and barium sulfate; conductive and semi-conductive fillers such as tin oxide, antimony-doped tin oxide, indium-doped tin oxide, antimony-doped titanium oxide, and carbon black; and the like. When a conductive or semi-conductive filler is used, it is possible to use it similarly to insulative fillers, by reducing its addition amount to its percolation threshold value or less. The term "insulating" means a volume resistivity of $10^{13}$ Ωcm or more. Hereinafter, the same shall apply, unless specified otherwise.

In such a case, the 50 percentile particle diameter (volume basis) of the filler may be 0.1 μm or more.

As will be described below, the absolute maximum length of the largest filler particle in the resin of intermediate transfer body may be smaller than the absolute maximum length of the largest polyaniline particle, and thus, a filler having a diameter satisfying the relationship may be used.

In addition, the loading rate is preferably 0.1 to 10% by volume fraction. Unfavorably, a volume fraction of less than 0.1% may lead to insufficient reinforcing action, while a volume fraction of more than 10% may lead to deterioration in the toughness of the molded product.

Examples of the methods of dispersing the filler and breaking the aggregates thereof include, but are not limited to, physical means such as mixer, agitation with stir, parallel roll, and ultrasonic dispersion; and chemical means, for example, of using a dispersant.

An endless belt-shaped intermediate transfer belt is prepared by using the coating liquid obtained, for example, by the method (A) or (B) below. The intermediate transfer body according to an aspect of the invention may be prepared by any other method, if it allows preparation of a molding in the endless-belt shape. A roll-shaped intermediate transfer body may be produced, instead of the endless belt-shaped transfer body. It may be prepared by any method, if it allows production of a roll-shaped transfer body.

Method (A)

A long film-shaped conductive polyimide film is prepared by applying a coating liquid on a stainless steel endless belt continuously with a T die, drying the film in an oven, for example, at 170 to 190° C. for 30 minutes continuously, winding the resulting film, baking the film in a baking oven (tenter oven), for example, at 370 to 390° C. for 7 minutes continuously while allowing imide-conversion reaction to proceed, and winding the baked film. After cut into a suitable size, the polyimide film obtained is converted into a desirable endless belt, for example, according to the puzzle-cut seaming method described in JP-A No. 2000-145895.

Method (B)

An endless belt is prepared by applying a coating liquid on the internal or external surface of a cylindrical metal mold and drying and baking the film.

A cylindrical mold made of any one of various known raw materials such as resin, glass, and ceramic may be used instead of the cylindrical metal mold. Alternatively, a glass or ceramic layer may be formed on the surface of the metal or other mold, and a silicone- or fluorine-based mold-release agent may be used as needed.

The thickness of the solution coated on the cylindrical metal mold may be controlled to even, by using a film thickness-controlling mold having a properly adjusted clearance to the cylindrical metal mold and removing excess solution while moving the thickness-controlling mold in parallel with the cylindrical metal mold. If the thickness of the coating liquid is properly adjusted in the step of applying the coating liquid onto the cylindrical metal mold, there is no need for installing such a film thickness-controlling mold.

Then, the cylindrical metal mold coated with the coating liquid is dried in a heated or vacuum environment, until 30 wt % or more, preferably 50 wt % or more, of the solvent contained in the coating liquid is evaporated (drying treatment).

The cylindrical metal mold is then heated at 200° C. to 450° C., allowing progress of the imide conversion reaction (baking treatment).

Then, removal of the resin-after imide conversion reaction from the metal mold gives a desired endless belt. The endless belt may be further processed in a step of cutting both ends of the belt.

Both in the methods (A) and (B), the endless belt is baked for acceleration of the imide conversion reaction. The imide-conversion temperature may vary according to the kind of the raw materials of polyamic acid materials used, tetracarboxylic dianhydride and diamine. The imide-conversion temperature may be a temperature at which the imide conversion is completed, for improvement in mechanical properties and electrical characteristics. The temperature may also vary according to the heat capacity of the metal mold, but in general baking at 200 to 450° C. for 5 to 45 minute may be carried out.

[Preparation of Intermediate Transfer Belt (2)]

The other method of preparing the intermediate transfer body is a method, including pulverizing a self-doped polyaniline into a powder having a 50 percentile particle diameter (volume basis) in the range of 0.05 to 3.0 μm and a 90 percentile particle diameter (volume basis) of equal to or greater than the 50 percentile particle diameter (volume basis) but not greater than twice the 50 percentile particle diameter (volume basis), mixing it with an added polyamic acid, and drying and baking the mixture.

The "self-doped polyaniline" is a polyaniline having an acidic group (e.g., sulfonic acid group) that may be a dopant in the polyaniline structure. Specifically, for example, a self-doped polyaniline, polyanilinesulfonic acid having an average molecular weight of approximately 10,000, can be prepared by a known method [e.g., J. Am. Chem. Soc., 1991, 113, 2665-2666, or others]. An example of the commercially available products thereof is a conductive coating agent aqua-PASS-01 (aqueous solution of polyanilinesulfonic acid) manufactured by Mitsubishi Rayon Co., Ltd.

The number-average molecular weight of the self-doped polyaniline may be 4,000 to 400,000 from the viewpoint of providing conductivity.

A pulverization method similar to that for the undoped polyaniline in preparation of the intermediate transfer belt (1) may be used for pulverization of the self-doped polyaniline. Generally, if a granular self-doped polyaniline is available, use of a dry jet mill is easier in handling than use of a wet jet mill. Examples of the liquids favorably used in dispersion of a self-doped polyaniline when a wet process is used for pulverization include DMAc (dimethylacetamide), NMP (N-methyl-2-pyrrolidone), and the like.

The content of the self-doped polyaniline in the dispersion may be in the range of 3 to 20 wt %, from the viewpoint of easiness in pulverization.

The particle size distribution of the self-doped polyaniline pulverized by the method is the same as that when an undoped polyaniline is pulverized as described above.

The self-doped polyaniline pulverized into the condition of the particle size distribution above is then mixed with a polyamic acid, giving a coating liquid.

The mixing in preparation of the coating liquid may be carried out using a mixing unit such as a stirrer, sand-grind mill, attriter, or the like, but is not particularly limited, if it can mix the coating liquid to homogeneity.

The polyamic acid used then is the same as that described above in the method of preparing intermediate transfer body (1).

Then, an endless belt-shaped intermediate transfer body may be prepared by using the coating liquid obtained and by the method (A) or (B) described in the preparation of intermediate transfer body (1).

The intermediate transfer body according to an aspect of the invention may be prepared by the method described in the preparation of intermediate transfer body (1) or (2) above.

In the intermediate transfer body, the absolute maximum length of the largest polyaniline particle in the polyimide resin thereof may be 10.0 μm or less. The production method thereof is not limited to the methods (1) and (2). For example, an endless belt may be prepared by dissolving a solvent-soluble polyimide in a solvent such as NMP or DMAc, preparing a coating liquid by adding a pulverized polyaniline thereto as described above, and applying the coating liquid. Alternatively, an endless belt may be prepared by blending a pulverized polyaniline prepared as described above into a thermoplastic polyimide and extrusion-molding the resin by using a T die or a cyclic die.

When the resin in the intermediate transfer body thus obtained contains a filler, the absolute maximum length of the largest polyaniline particle (a) and the absolute maximum length of the largest filler particle (b) may satisfy the relationship represented by the following Formula (1):

$$10.0\ \mu m \geqq \text{Absolute maximum length (a)} > \text{Absolute maximum length (b)} \geqq 0.1\ \mu m \qquad \text{Formula (1)}$$

The "absolute maximum length of the largest filler particle" is the distance between two most separated points on the maximum filler particle that has the longest particle length among the filler particles contained in the polyimide resin.

The absolute maximum length of the filler can be determined by a method similar to that used in determination of the absolute maximum length of the largest polyaniline particle described above and by using the same test sample. The filler, which is different in color tone from polyimide or polyaniline, can be identified then, easily.

In an embodiment, if the resin contained in the intermediate transfer body is a polyimide resin, a copolymer (having the following structure) of BPDA (3,3',4,4'-biphenyltetracarboxylic dianhydride) and ODA (4,4'-diaminodiphenylether) may be contained or a mixture of a copolymer of BPDA (3,3',4,4'-biphenyltetracarboxylic dianhydride) and ODA (4,4'-diaminodiphenylether) and a copolymer (having the following structure) of PMDA (pyromellitic dianhydride) and ODA (4,4'-diaminodiphenylether) may be contained.

The copolymer is advantageous in that it is easier to prepare the coating liquid during production of an intermediate transfer belt and also in that it is possible to adjust the surface micro-hardness into a favorable range. By adding the filler described above additionally to such a polyimide resin it is possible to improve the mechanical strength of the intermediate transfer belt and effectively prevent expansion of the intermediate transfer belt by humidity and temperature.

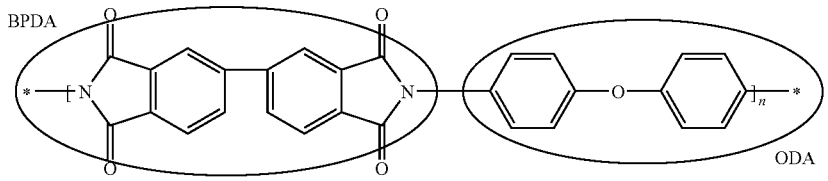

Copolymer of BPDA and ODA

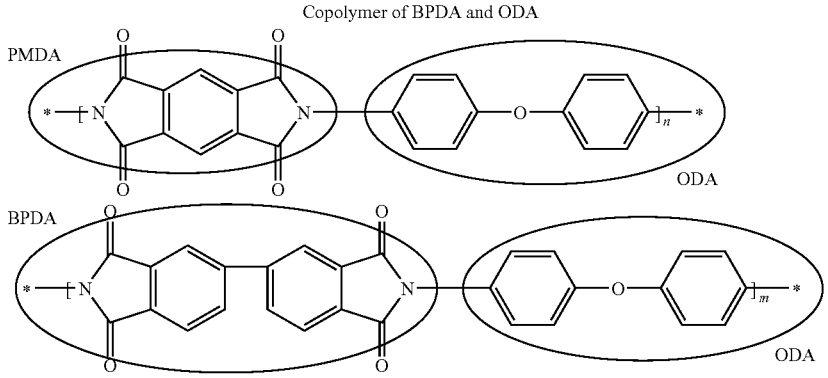

Mixture of PMDA/ODA copolymer and BPDA/ODA copolymer

The intermediate transfer body preferably has a humidity expansion coefficient of 45 ppm/% RH or less and a thermal expansion coefficient of 45 ppm/K or less.

It is possible to prevent local expansion of the intermediate transfer belt and give a stabilized belt-traveling speed, when the expansion coefficients are in the ranges above. As a result, it is possible to obtain a high-quality transferred image, independent of the environment, temperature and humidity, inside the image-forming apparatus.

The humidity expansion coefficient is more preferably 30 ppm/% RH or less, and the thermal expansion coefficient, 30 ppm/K or less.

The humidity expansion coefficient is determined in the following manner: First, a sample is prepared by cutting an intermediate transfer belt into a piece having a width of 25.4 mm and a length of 210 mm. Then, the length direction of the sample is aligned in parallel with the circumferential direction of the intermediate transfer body. The sample is connected to a chuck of 0.240 kg in weight in its lower region and to another chuck fixed to a supporting stand in its upper region; and the sample is held vertically at a chuck distance of 149 mm. The expansion or shrinkage of the sample, which corresponds to the vertical movement of the lower chuck, is determined by the vertical displacement of the lower belt region as measured by a microgauge fixed on the supporting stand. The expansion/shrinkage amount is expressed by a numerical value with plus (+) when the test piece expanded or with minus (−) when shrunk. A microgauge ID-S1012 (minimum scale: 0.01 mm, precision: 0.02 mm) manufactured by Mitsutoyo Corp. may be used for that purpose. The sample is left as it is held vertically in a constant-temperature/humidity bath in an environment at (a) 22° C. and 55% RH for 24 hours; and the sample length is corrected by using the expansion/shrinkage ΔLa of the sample then. Then, the expansion/shrinkage of the sample, ΔL20 or ΔL85, is determined after it is left in an environment at (b) 35° C. and 20% RH or (c) 35° C. and 85% RH for 24 hours. The humidity expansion coefficient H is represented by the following Formula (2):

$$H(\text{ppm}/\%\,RH)=10^6\times(\Delta L85-\Delta L20)_{(mm)}/(149-\Delta La)_{(mm)}/(85-20)_{(\%\,RH)} \quad \text{Formula (2)}$$

The measurement was repeated for a total of six times, thrice with respect to the conditional change of (b) to (c) and thrice with respect to the conditional change of (c) to (b), and the average is designated as the humidity expansion coefficient.

On the other hand, the thermal expansion coefficient of the intermediate transfer body is determined in the following manner: First, a sample having a width of 3.0 mm and a length of 10.0 mm is cut off from an intermediate transfer body. The length direction of the sample is aligned in parallel with the circumferential direction the intermediate transfer body. The sample is heated from room temperature to 200° C. at a programmed heating rate of 5°/minute and then cooled to 100° C., and the thermal expansion coefficient is determined from the sample length during cooling. A thermomechanical analyzer TMA-50 manufactured by Shimadzu Corporation may be used for measurement. The thermal expansion coefficient is calculated according to the Formula shown in the "Testing method for linear thermal expansion coefficient of plastics by thermomechanical analysis" specified by JIS K7197 (1991), the disclosure of which is incorporated by reference herein.

The intermediate transfer body preferably has a surface roughness Ra in the range of 0.010 to 0.050 μm, more preferably in the range of 0.010 to 0.040 μm, from the viewpoints of the transfer and cleaning efficiency of the toner image. The surface roughness Ra can be controlled by properly selecting the kind of the resin used and adjusting the amount of the polyaniline blended in the range above. The surface roughness Ra is the arithmetic mean roughness specified in JIS B0601 (1994), the disclosure of which is incorporated by reference herein. The surface roughness Ra is determined by pre-processing a test sample obtained by cutting off part of a belt base material prepared by the method (A) or (B) described in preparation of intermediate transfer belt (1) by PtAu sputtering, and analyzing the sample by using an electron microscope (S-4200, manufactured by Hitachi) and a three-dimensional shape analyzer (RD-500, manufactured by DKL). The test conditions are as follows: accelerating voltage: 10 kv, magnification: 1,000, working distance: 15 mm; and a band pass filter at an FFT of 5 to 200 Hz is used during data processing.

In addition, the intermediate transfer body preferably has a micro-glossiness, as determined at an incident angle of 75° to the transfer face, in the range of 95 to 120 gloss units, more preferably in the range of 100 to 120 gloss units. The micro-glossiness can be controlled by selecting the kind of the resin used properly and adjusting the amount of the polyaniline blended in the range above.

The micro-glossiness is determined by using Microgloss 750 (Type 4553, manufactured by BYK Gardner).

In addition, the intermediate transfer belt preferably has a surface micro-hardness of 25 mN/μm$^2$ or less, more preferably 20 mN/μm$^2$ or less, for reducing the pressure applied onto the developer (toner) during transfer and reducing disconnection of linear images (hollow character).

The micro-hardness is determined in the following manner: First, an intermediate transfer belt is cut to a piece of 6 mm square, and the small piece thereof is bonded to a glass plate with an instant adhesive with its image-receiving face during image transfer facing upward. The dynamic micro-hardness of the surface layer of this sample is determined by using a micro-hardness meter DUH-201s (manufactured by Shimadzu Corporation).

The "dynamic micro-hardness" is determined not by the method commonly used in hardness measurement of metal materials, such as Vickers hardness, of determining the diagonal length of dents, but by a method of measuring the depth of its indenter penetrating into sample. When the test load is designated as P (mN) and the depth of the indenter penetrating into sample (penetration depth) as D (μm), the dynamic micro-hardness DH (mN/μm$^2$) is defined by the following Formula (3):

$$DH \geqq \alpha P/D^2 \quad \text{Formula (3)}$$

In the Formula, α is an constant depending on the shape of the indenter, and α is 3.8584 when the indenter used is a triangular pyramid indenter.

The surface micro-hardness is a hardness calculated from the load during penetration of the indenter and the penetration depth, and represents a mechanical property of the sample including both plastic and elastic deformations. In addition, the test area is very small, and the method allows more accurate determination of the hardness in the area almost close to the size of toner particle. Test conditions are summarized below, and an average of ten results at arbitrary points of sample is designated as the dynamic micro-hardness of the sample.

Measurement environment: 22° C., 55% RH
Indenter used: triangular pyramid indenter
Test mode: 3 (soft material test)
Test load: 0.70 gf
Load velocity: 0.014500 gf/sec
Retention period: 5 sec The intermediate transfer body preferably has a tensile modulus of 2,500 MPa or more, more preferably 3,500 MPa or more, for prevention of breakage of belt and improvement in color registration. The tensile modulus is preferably greater, but practically, preferably 8,000 MPa or less, more preferably 6,000 MPa or less, from the viewpoint of the durability of the image-forming apparatus carrying the intermediate transfer body. Examples of the resins include polyimide resins, polyamide-imide resins, polyester resins, polyamide resins, fluorine resins, and the like, and these resins may be used as the materials of the resin layer in the intermediate transfer body. It is possible to control the tensile modulus of the intermediate transfer belt in a suitable range, by properly selecting the chemical structure of the resin material used; and a resin material containing a greater number of aromatic ring structures is more effective in improving the tensile modulus. Considering the actual environment for use, the tensile modulus of the intermediate transfer body after conditioning in an environment of at 28° C. and 85% RH, and/or, at 22° C. and 55% RH for 24 hours or more may be in the range above.

The tensile modulus can be determined in the following manner: The test piece used is the same as the Type-2 test piece specified by JIS K7127 (1999), the disclosure of which is incorporated by reference herein. A sample is prepared by cutting an intermediate transfer belt into a test piece having a width of 10 mm and a length of 200 mm. The length direction then is in parallel with the circumferential direction of the intermediate transfer body. The tensile modulus is determined at an initial chuck distance of 100 mm±5 mm and a stress rate of 10 mm/minute, and calculated according to the method of JIS K7127 (1999).

The surface resistivity of the intermediate transfer body according to an aspect of the invention is preferably $1\times10^{10}$ to $1\times10^{14}\Omega/\square$ and more preferably, $1\times10^{11}$ to $1\times10^{13}\Omega/\square$. A surface resistivity of higher than $1\times10^{14}\Omega/\square$ may cause easier release discharge in the post-nip region where the image holding member in the primary transfer area is separated from the intermediate transfer body, and consequently, deterioration in quality of the image, such as white deletion, in the electrically discharged area. On the other hand, a surface resistivity of less than $1\times10^{10}\Omega/\square$ may lead to increase in the electric-field strength in the pre-nip portion and deterioration in the image-quality such as graininess in the pre-nip portion because of the gap discharge there.

Thus, a surface resistivity in the range above may prevent the white deletion caused when the surface resistivity is higher and the deterioration in image quality caused when the surface resistivity is lower.

In addition, the volume resistivity of the intermediate transfer body according to an aspect of the invention is preferably $1\times10^{8}$ to $1\times10^{13}$ Ωcm and more preferably $1\times10^{9}$ to $1\times10^{12}$ Ωcm. A volume resistivity of less than $1\times10^{8}$ Ωcm may make the electrostatic force, which preserves the charge on the unfixed toner image transferred from the image holding member onto the intermediate transfer body, weaker and results in scattering of the toner (blurring) caused by the electrostatic repulsive force among toner particles and the electrostatic force caused by the fringe electric field near the image edge; and thus, such a transfer body may give an image with higher noise. In contrast, if the volume resistivity is higher than $10^{13}$ Ω·cm, a discharging mechanism will be needed, as the intermediate transfer body surface is charged by the transfer electric field during primary transfer due to its high charge-retaining capacity.

Therefore, by adjusting the volume resistivity in the range above, it is possible to prevent the scattering of toner particles and to provide a solution to the problem of requiring a discharging mechanism.

In the image-forming apparatus of the embodiment described above, the configuration of a high speed multi-paper-output image-forming apparatus was described, but is not limited thereto, and, for example, a low-speed fewer-paper-output image-forming apparatus may be used instead.

Figure 2:
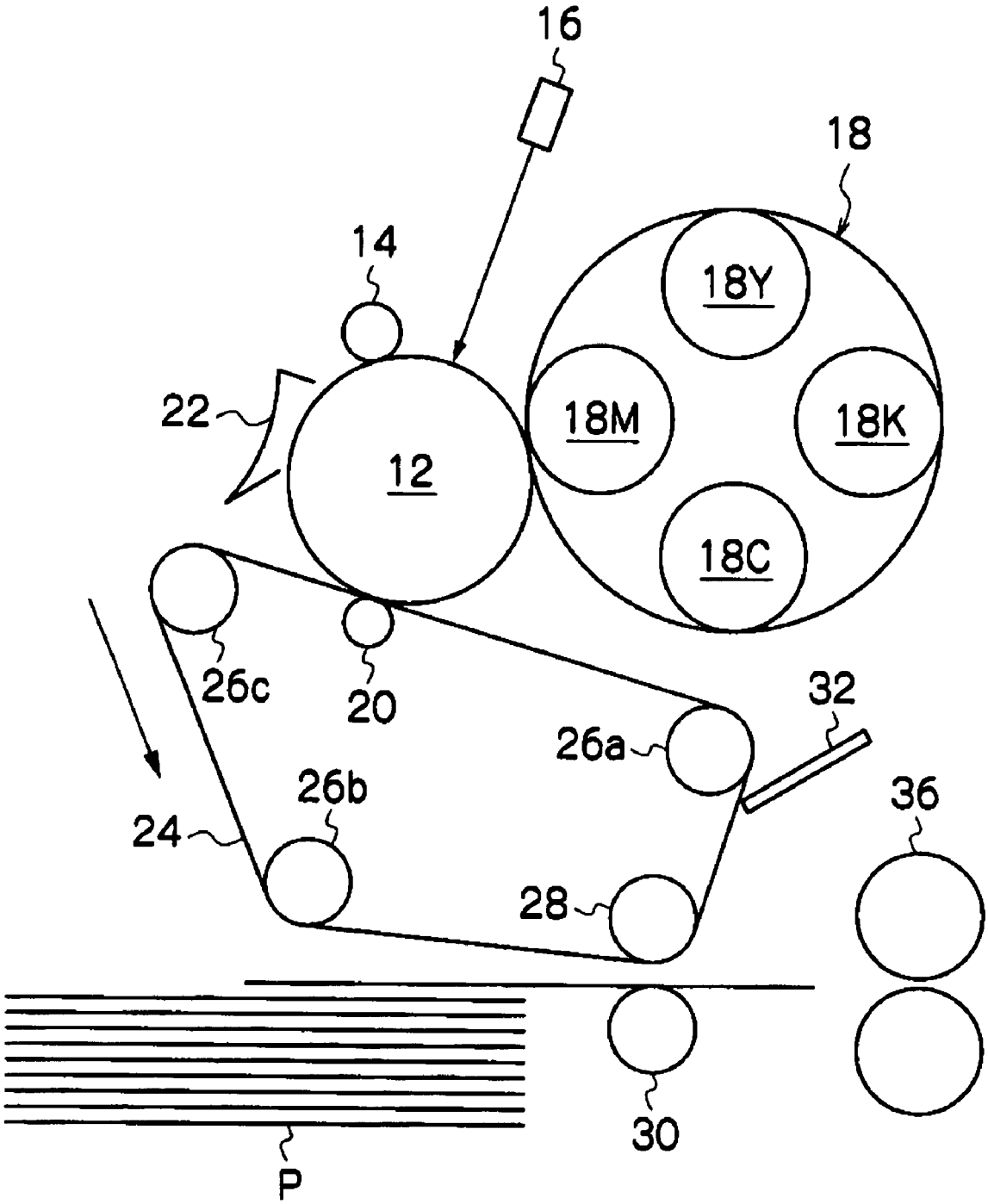
FIG. 2 is a schematic view illustrating the configuration of another exemplary embodiment of the image-forming apparatus.

FIG. 2 is a schematic view illustrating the image-forming apparatus in another exemplary embodiment.

As shown in FIG. 2, the image-forming apparatus in this exemplary embodiment has, for example, an photoreceptor drum 12 as its image-holding member, and additionally along its periphery, a charging device 14 that charges the surface of the photoreceptor drum 12, an exposure devise 16 that forms an electrostatic latent image on the surface of the charged photoreceptor drum 12, a rotary developing device 18 (including developing devices 18Y, 18M, 18C, and 18K therein) that converts the electrostatic latent image formed on the surface of the photoreceptor drum 12 into a toner image with a toner contained in a developer, a primary transfer device 20 that transfers the toner image onto an intermediate transfer belt 24 that is an intermediate transfer body, and a photoreceptor drum cleaner 22 that removes the residual toner deposited on the surface of the photoreceptor drum 12 after transfer.

There is also an intermediate transfer belt 24 placed at the position facing the photoreceptor drum 12. The intermediate transfer belt 24 is placed between the photoreceptor drum 12 and the primary transfer device 20. The intermediate transfer belt 24 is supported rotatably by a drive roll 26*a*, a tension roll 26, a supporting roll 26*b* and a backup roll 28 as it is pushed outward from the internal face side.

Along the periphery of the intermediate transfer belt 24, there are placed a secondary transfer device 30 at the position facing the backup roll 28 via the intermediate transfer belt 24, and a belt cleaner 32 downstream of the secondary transfer device 30 in the rotation direction of the intermediate transfer belt 24.

In addition, a fixing device 36 is placed downstream in the conveying direction of the recording paper P (recording medium) onto which the toner image has been transferred by the secondary transfer device 30.

In the image-forming apparatus in this exemplary embodiment, the photoreceptor drum 12 revolves clockwise, and the surface is charged by a charging device 14. An electrostatic latent image in the first color (for example, Y) is formed on the charged photoreceptor drum 12 by an exposure devise 16 such as laser-writing device.

The electrostatic latent image is developed by a developing device 18Y in the developing device 18 into a visible toner image. The toner image advances to the primary transfer region by revolution of the photoreceptor drum 12, where the toner image is primary-transferred onto the intermediate transfer belt 24 revolving counterclockwise when an electric field in the polarity opposite to that of the toner image is applied from the primary transfer device 20.

Hereinafter similarly, a toner image (M) in the second color, a toner image (C) in the third color, and a toner image (K) in the fourth color are formed one by one by developing devices 18M, 18C and 18K in the developing device 18 and superimposed on the intermediate transfer belt 24, to form a multi-color toner image.

By revolution of the intermediate transfer belt 24, the multi-color toner image transferred on the intermediate transfer belt 24 reaches a secondary transfer region where a secondary transfer device 24 is placed.

In the secondary transfer region, the toner image is transferred onto recording paper P by electrostatic repulsion, while a bias (transfer voltage) at the same polarity with the toner image is applied between the secondary transfer device 30 and a backup roll 28 present at the position facing it via the intermediate transfer belt 24.

The recording paper P is picked up one by one from the recording paper pile stored in a recording paper container (not shown in the Figure) by a pickup roller (not shown in the Figure), and fed into the space between the intermediate transfer belt 24 and the secondary transfer device 30 in the secondary transfer region at a particular timing by a feed roll (not shown in the Figure).

The toner image held on the intermediate transfer belt 24 is transferred onto the recording paper P supplied, by application of pressure and transfer voltage by the secondary transfer device 30 and the backup roll 28 and also by rotation of the intermediate transfer belt 24.

The recording paper P onto which the toner image has been transferred is conveyed to the fixing device 36, where the toner image is fixed into a permanent image by application of pressure and heat.

The toner remaining on the intermediate transfer belt 24 after the multi-color toner image is transferred onto the recording paper P is removed by the belt cleaner 32 installed at a position downstream of the secondary transfer region, before entering into the next transferring cycle. In addition, foreign materials deposited during transfer such as toner particles and paper dust are removed by brush cleaning (not shown in the Figure) in the secondary transfer device.

In the case of a single-color image, a primary-transferred toner image in a single color is secondary-transferred and sent to the fixing device, but, in the case of a multicolor image in which multiple colors are superimposed, toner images in various colors are transferred with rotation of the intermediate transfer belt 24 and the photoreceptor drum 12 synchronized to make the toner images superimposed accurately in the primary transfer region without any positional deviation.

In this way, an image is formed on the recording paper P (recording medium) in the image-forming apparatus in the exemplary embodiment.

It is needless to say that the invention should not be construed in a restricted way and may be worked in any way in the scope satisfying the requirements in the exemplary embodiments above.

EXAMPLES

Hereinafter, Examples and Comparative Examples of the invention will be described below. These Examples are aimed only for exemplification, and it should be understood that the scope of the present invention is not restricted thereby.

Example A1

Preparation of Intermediate Transfer Belt A

<Preparation of Polyamic Acid Solution (A-1)>

4,4'-Diaminodiphenylether (ODA) was dissolved in DMAc solvent; 3,3',4,4'-biphenyltetracarboxylic dianhydride (BPDA) and pyromellitic dianhydride (PMDA) are added thereto; and the mixture is stirred thoroughly under nitrogen atmosphere. The ratio of ODA:BPDA:PMDA is adjusted to 1.00:0.55:0.45 by mole, to give a polyamic acid solution (A-1) at a concentration of 20% by weight.

<Polyaniline in the Undoped State and Dopant>

PANIPOL PA manufactured by Panipol is used as the polyaniline in the undoped state.

Para-phenolsulfonic acid in an amount of 30% mole equivalence with respect to the polyaniline in the undoped state (i.e., 60% with respect to 100% of half of the mole equivalence of the polyaniline in the undoped state) is used as the dopant. Para-phenolsulfonic acid is added to and stirred in the DMAc solvent under nitrogen atmosphere, to give a homogeneous dopant solution at a concentration of 5% by weight.

<Preparation of Polyaniline Dispersion (B-1)>

PANIPOL PA manufactured by Panipol, a polyaniline in the undoped state, is pulverized in a dry jet mill. A counter jet mill (type 100AFG) manufactured by Hosokawamicron Co., Ltd. is used as the dry jet mill.

The counter jet mill includes (1) a raw material-supplying unit FTS-20, (2) a counter jet mill 100AFG, (3) a product-collecting unit 1 (Φ100 cyclone), (4) a product-collecting unit 2 (P-bag, filtration area: 2.3 square meters), and (5) an exhaust blower. The conditions for pulverization are primarily as follows: pulverization air flow: 100 cubic meters per minute, air pressure: 600 kPa, and classification rotational velocity: 20,000 rpm.

The polyaniline collected then in the product-collecting unit 2 (P-bag) is designated as the first polyaniline particles, and a small portion thereof is dispersed in ethanol. Analysis of the particle size distribution of the first polyaniline particles shows that the 50 percentile particle diameter (volume basis) is 1.4 μm; the 90 percentile particle diameter, 2.4 μm; and the 100 percentile particle diameter (volume basis), 5.9 μm.

250 Parts by weight of the pulverized first polyaniline particles and 25 parts by weight of PVP (polyvinylpyrrolidone) are added gradually to the dopant solution at a concentration of 5 wt %, in an amount corresponding to a predetermined doping amount with respect to 250 parts by weight of polyaniline, under nitrogen atmosphere. The mixture is then stirred uniformly, to give a doped polyaniline dispersion (B-1).

<Preparation of Coating Liquid (C-1)>

The polyamic acid solution (A-1) and the doped polyaniline dispersion (B-1) obtained by the method above are mixed uniformly, to give a coating liquid. The solid-matter weight ratio of the doped polyaniline (PAn) to the polyamic acid (PAA) PAn:PAA is 12:88. DMAc solvent is added to adjust its viscosity in the range suitable for coating.

<Preparation of Endless Belt>

The coating liquid obtained is coated uniformly on the inner surface of a cylindrical SUS mold having an inner diameter of 365.5 mm and a length of 600 mm. The inner surface of the cylindrical mold is previously coated with a fluorine-based releasing agent for facilitating removal of the belt after preparation.

Then, the coated film is dried at a temperature of 120° C. for 30 minutes while the metal mold is rotated. After drying, the metal mold is placed in an oven and baked at 320° C. approximately for 30 minutes, allowing imide conversion reaction to proceed.

The metal mold is then cooled at a room temperature (22° C.), and the resin is removed from the metal mold, to give an endless belt.

Both ends of the endless belt obtained are cut, to give an intermediate transfer belt A having a circumferential length of 1.148 mm and a width 369 mm. The thickness of the intermediate transfer belt is 0.08 mm.

[Evaluation of Intermediate Transfer Belt]

First, the absolute maximum length of the largest polyaniline particle, the 50 percentile particle diameter (number basis) and the 90 percentile particle diameter (number basis) of the polyaniline particles in each of the intermediate transfer belts are determined, and the particle size distribution is also calculated from the 50 percentile particle diameter and the 90 percentile particle diameter.

The "absolute maximum length of the largest polyaniline particle" is determined by collecting nine samples from one belt, three points in the length direction×three points in the width direction (the intervals in the width and length directions are almost the same), and measuring the absolute maximum lengths of the largest polyaniline particle in six visual fields of each sample. The specific measuring method is the same as that described above.

The "50 percentile particle diameter (number basis) of polyaniline particles and the 90 percentile particle diameter (number basis) of polyaniline particles" are determined by collecting nine samples from one belt, three points in the width direction×three points in the length direction and measuring the samples in a similar manner to above.

Evaluation of Appearance (Yield)

The appearance (transfer face) of each of the intermediate transfer belts is evaluated, and the belt having no surface defects such as raised spots or dents is regarded to have acceptable appearance. A boundary sample is used for evaluation of the surface defects such as raised spot and dent. A raised spot having a diameter of 300 μm and a height of 20 μm or more and a dent visually detectable having a depth of 20 μm or more independent of the outer diameter (usually, 10 mm or less) are regarded as surface defects. Table 1 shows the number of the samples having acceptable appearance in 20 samples.

The evaluation criteria for the number of samples having acceptable appearance in Table 1 are as follows:

A: 19 or more acceptable samples out of 20

B: 17 to 18 acceptable samples out of 20

C: 16 or less acceptable samples out of 20

The "electrical properties", the "surface physical properties", and the "quality of transferred image" described below are evaluated by using three samples picked up from the samples having acceptable appearance.

Evaluation of Electrical Properties (Measurement of Electric Resistivity)

The surface resistivity of intermediate transfer belt is determined by using a digital ultrahigh-resistance/minute-current ammeter R8340A (manufactured by Advantest Corporation), and a UR probe MCP-HTP12 having a double-ring-electrode structure whose connection part has been modified for R8340A, and a Resitable UFL MCP-ST03 (both, manufactured by Dia Instruments).

The surface resistivity of each of the three intermediate transfer belts arbitrarily picked up is determined at 24 points, six points in the width direction×four points in the length direction, and the results are shown in the form of average±range in Table 1. The results of the measurement show that there is no difference between the three belts.

The Resitable UFL MCP-ST03 is placed inside the intermediate transfer belt with its fluoroplastic-surfaced face facing upward, and the double electrode of the UR probe MCP-HTP12 is brought into contact with the transfer face of the belt (outside of the belt). A uniform load is applied on the transfer face of the intermediate transfer belt by placing a weight of 2.00±0.10 kg (19.6±1.0 N) on the UR probe MCP-HTP12.

The digital ultrahigh-resistance/minute-current ammeter probe R8340A is used under the condition of a charge time of 30 sec, a discharge time of 1 sec, and an applied voltage of 100 V.

When the surface resistivity then is designated as ρs; the reading of the digital ultrahigh-resistance/minute-current ammeter probe R8340A, as R; and the surface resistivity correction coefficient of the UR probe MCPHTP12, as RCF (S), because RCF(S) is 10.00 according to the catalog of the "Resistance Meter Products" of Mitsubishi Chemical Corp., the surface resistivity is expressed by the following Formula (4):

$$\rho s\ [\Omega/\mathrm{cm}^2] = R \times RCF(S) = R \times 10.00. \qquad \text{Formula (4)}$$

(Measurement of Volume Resistivity)

The volume resistivity of the intermediate transfer belt is determined by using a digital ultrahigh-resistance/minute-current ammeter probe R8340A (manufactured by Advantest Corporation) and a UR probe MCP-HTP12 having a double-ring-electrode structure whose connection part has been modified for R8340A and a Resitable UFL MCP-ST03 (both, manufactured by Dia Instruments).

In a similar manner to the surface resistivity measurement above, the volume resistivity of each of three intermediate transfer belts arbitrarily picked up is also determined at 24 points, six points in the width direction×four points in the length direction, and the results are shown in the form of average±range in Table 1. The measurement results show that there is no difference between the three belts. The intermediate transfer belt used for measurement of volume resistivity may be the same as the intermediate transfer belt used in measurement of surface resistivity.

The Resitable UFL MCP-ST03 is placed inside the intermediate transfer belt with its metal face facing upward, and the double electrode part of the UR probe MCP-HTP12 is brought into contact with the transfer face of the belt (outside of the belt). An uniform load is applied on the transfer face of the intermediate transfer belt by placing a weight of 2.00±0.10 kg (19.6±1.0 N) on the UR probe MCP-HTP12.

The digital ultrahigh-resistance/minute-current ammeter probe R8340A is used under the condition of a charge time of 30 sec, a discharge time of 1 sec, and an applied voltage of 100 V.

When the volume resistivity then is designated as ρv; the thickness of the intermediate transfer body, as t (um); the reading of the digital ultrahigh-resistance/minute-current ammeter probe R8340A, as R; and the volume-resistivity correction coefficient of the UR probe MCP-HTP12, as RCF (V), because RCF(V) is 2.011 according to the catalog of the "Resistance Meter Products" of Mitsubishi Chemical Corp., the volume resistivity is expressed by the following Formula (5):

$$\rho v\ [\Omega\cdot\mathrm{cm}] = R \times RCF(V) \times (10{,}000/t) = R \times 2.011 \times (10{,}000/t). \qquad \text{Formula (5)}$$

The evaluation criteria for the surface and volume resistivities in Table 1 are as follows:

A: The range in average±range is not larger than 0.1 (satisfactory)

B: The range in average±range is more than 0.1 and 0.2 or less (practically allowable)

C: The range in average±range is more than 0.2 (unsatisfactory)

Evaluation of Surface Physical Properties (Measurement of Surface Roughness Ra)

The surface roughness Ra is determined by measuring four points on each of three intermediate transfer belts arbitrarily picked up, according to the method described above. Table 1 shows the minimum to maximum values. The evaluation criteria for the surface roughness Ra shown in Table 1 are as follows:

A: Maximum value is 0.05 μm or less (satisfactory)

B: Maximum value is more than 0.05 μm and 0.07 μm or less (demanding some adjustment of the system)

C: Maximum value is more than 0.07 μm (unsatisfactory)

(Measurement of Micro-Glossiness)

The micro-glossiness at an incident angle of 750 of each of three intermediate transfer belts arbitrarily picked up is also determined at 24 points, respectively six points in the width direction and four points in the length direction, and the results are shown as the minimum to maximum values in Table 1.

The evaluation criteria for the micro-glossiness shown in Table 1 are as follows:

A: The minimum is 95 gloss units or more (satisfactory)

B: The minimum is 90 gloss units or more and less than 95 gloss units (demanding some adjustment of the system)

C: The minimum is less than 90 gloss units (unsatisfactory)

(Measurement of Sharpness)

The sharpness is determined at one point of each of three intermediate transfer belts arbitrarily picked up, according to the method shown below. Table 1 shows the result of the belt worst in evaluation.

Figure 3:
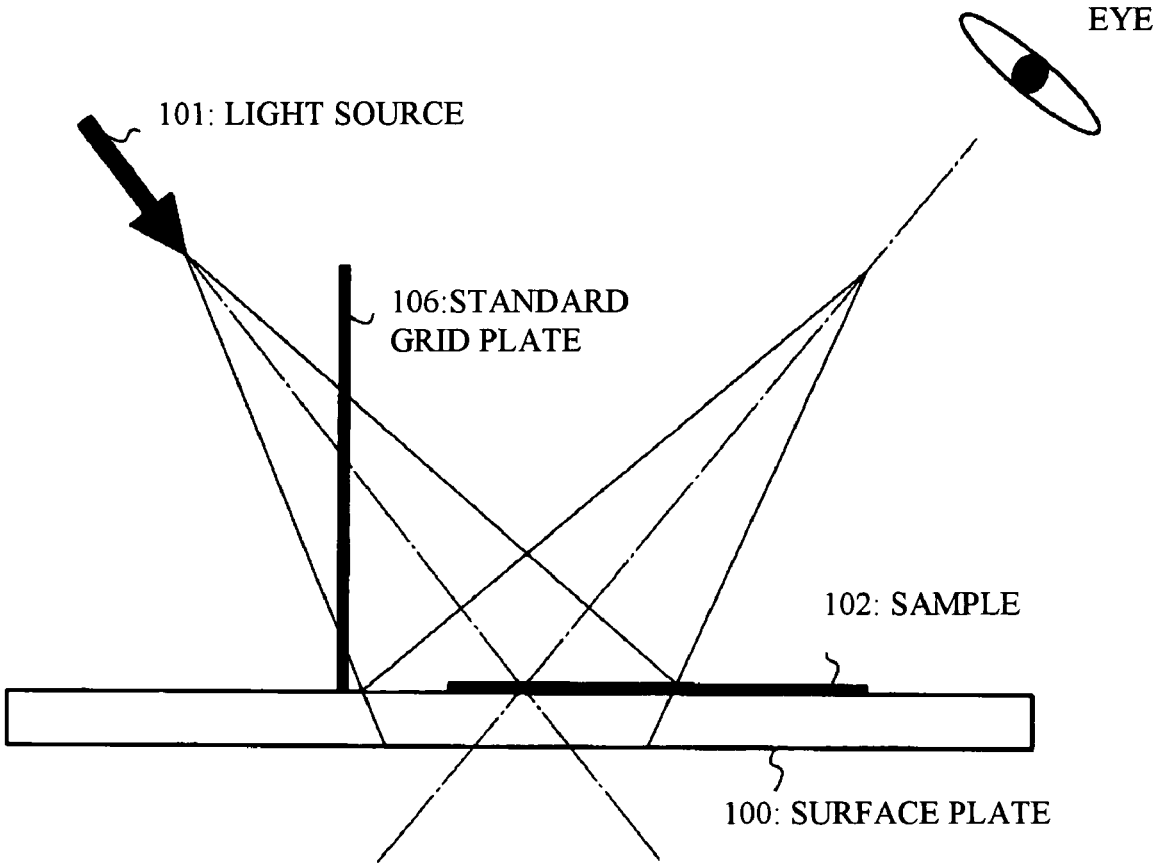
FIG. 3 is a chart illustrating a method of evaluating sharpness.

First as shown in FIG. 3, an intermediate transfer belt sample 102 is placed on a surface plate 100; a light from a light source 101 (fluorescent lamp) is irradiated at a particular angle, via a standard grid plate 106 placed above the surface plate 100, onto the transfer face of the intermediate transfer belt; and the deformation and sharpness of the grid formed on the transfer face are evaluated by visual observation. The standard grid plate 106 has a grid of 10 mm square. The evaluation criteria for the sharpness shown in Table 1 are as follows:

A: Very small grid deformation and definite thin grid line (satisfactory)

B: Very small grid deformation, but bleeding and medium-thickness grid line (practically allowable)

C: Small grid deformation, but bleeding and thick grid line (unsatisfactory)

[Preparation of Developer]

<Preparation of Resin Particle Dispersion>

Styrene: 296 parts n-Butyl acrylate: 104 parts

Acrylic acid: 6 parts

Dodecanethiol: 10 parts

Divinyl adipate: 1.6 parts (all, manufactured by Wako Pure Chemical Industries)

A mixture obtained by mixing and dissolving the components above is added to a solution obtained by dissolving 12 parts of a nonionic surfactant (NONIPOL 400, manufactured by Sanyo Chemical Industries Co., Ltd.) and 8 parts of an anionic surfactant (NEOGEN SC, manufactured by Dai-ichi Kogyo Seiyaku Co., Ltd.) in 610 parts of ion-exchange water, the mixture thus obtained is then dispersed and emulsified in a flask. While the mixture is mixed gently for 10 minutes, 50 parts of ion-exchange water containing 8 parts of ammonium persulfate (manufactured by Wako Pure Chemical Industries) is added thereto and then the air is purged with nitrogen at 0.1 liter/minute for 20 minutes.

Then, the mixture is heated to 70° C. in an oil bath while stirred in the flask, allowing emulsion polymerization for 5 hours, to give a resin particle dispersion (1) containing particles having an average diameter of 200 nm and having a solid matter concentration of 40%. Part of the dispersion is left in an oven at 100° C. for removal of water, and DSC (differential scanning calorimeter) analysis of the dried sample is carried out. A glass transition point is 53° C. and a weight-average molecular weight is 32,000.

<Preparation of Colorant Dispersion (Y)>

C.I. Pigment Yellow 74 (monoazo pigment): 100 parts (SEIKAFAST Yellow 2054, manufactured by Dainichiseika Color & Chemicals Mfg.)

Anionic surfactant (NEOGEN RK, manufactured by Dai-ichi Kogyo Seiyaku Co., Ltd.): 10 parts Ion-exchange water: 490 parts The mixture of the components above is dissolved and dispersed in a homogenizer (ULTRA-TURRAX manufactured by IKA) for 10 minutes, to give a colorant dispersant (Y).

<Preparation of Colorant Dispersion (M)>

A colorant dispersion (M) is prepared in a similar manner to colorant dispersion (Y), except that the colorant is replaced with C.I. Pigment Red 122 (quinacridone pigment: CHROMOFINE Magenta 6887 manufactured by Dainichiseika Color & Chemicals Mfg.).

<Preparation of Colorant Dispersion (C)>

A colorant dispersion (C) is prepared in a similar manner to the colorant dispersion (Y), except that the colorant is replaced with C.I. Pigment Blue 15:3 (phthalocyanine pigment: cyanine blue 4937, manufactured by Dainichiseika Color & Chemicals Mfg.).

<Preparation of Colorant Dispersion (K)>

A colorant dispersion (K) is prepared in a similar manner to colorant dispersion (Y), except that the colorant is replaced with carbon black (REGAL 330, manufactured by Cabot Corporation).

<Preparation of Releasing Agent Particle Dispersion>

Paraffin wax (HNP-9, manufactured by Nippon Seiro Co., Ltd.): 100 parts

Anionic surfactant (Lipal 860K, manufactured by Lion Co., Ltd.): 10 parts

Ion-exchange water: 390 parts

The components above are mixed and dissolved and the mixture is dispersed in a homogenizer (ULTRA-TURRAX manufactured by IKA) and then is dispersed additionally in a high-pressure-extrusion homogenizer, to give a releasing-agent-particle dispersion containing releasing agent (paraffin wax) particles having an average diameter of 220 nm dispersed therein.

<Preparation of Toner A>

Resin particle dispersion: 320 parts

Colorant dispersion: 80 parts

Releasing-agent-particle dispersion: 96 parts

Aluminum sulfate (manufactured by Wako Pure Chemical Industries): 1.5 parts

Ion-exchange water: 1,270 parts

The mixture of the components above is placed in a round stainless steel flask equipped with a temperature-controlling jacket, dispersed with a homogenizer (ULTRA-TURRAX T50 manufactured by IKA) at 5,000 rpm for 5 minutes, transferred into a flask, and left at 25° C. for 20 minutes while stirred with a 4-blade paddle. The mixture is heated while stirred at a heating rate of 1° C./minute to an internal temperature of 48° C. and held at 48° C. for 20 minutes. Then, 80 parts of the resin particle dispersion is added thereto additionally, and, the mixture is left at 48° C. for 30 minutes, and then is adjusted to pH 6.5 by addition of aqueous 1 N sodium hydroxide solution.

The mixture is then heated to 95° C. at a heating rate of 1° C./minute and held at the same temperature for 30 minutes. The mixture is adjusted to pH 4.8 by addition of aqueous 0.1 N nitric acid solution and left at 95° C. for 2 hours. The aqueous 1 N sodium hydroxide solution is then added additionally, to pH 6.5, and the mixture is left at 95° C. for 4.7 hours. The mixture is then cooled gradually at a rate of 10° C./minute to 30° C.

The toner particle dispersion obtained is filtered; (A) 2,000 parts of ion-exchange water at 35° C. is added to the toner particle obtained; and (B) the mixture is stirred for 20 minutes and then (C) filtered. The operations (A) to (C) are repeated for five times, and the toner particles on filter paper are transferred into a vacuum dryer and dried at 45° C. at a pressure of 1,000 Pa or below for 10 hours. The pressure is kept 1,000 Pa or below, because the toner particles described above are in the wet state, water therein is frozen even at 45° C. in the initial drying stage, and then sublimates, and thus the internal pressure of the drier under reduced pressure may be fluctuated. However, the internal pressure was stabilized at 100 Pa at the end of the drying. After the drier was back under atmospheric pressure, the particles are taken out, to give a toner A.

<Preparation of Carrier>

Ferrite particle (average diameter: 50 μm): 100 parts

Toluene: 14 parts

Styrene-methacrylate copolymer (component ratio: 90/10): 2 parts

Carbon black (R330, manufactured by Cabot Corporation): 0.2 part

First, the components excluding ferrite particles are blended with a stirrer for 10 minutes, to give a dispersed coating liquid; then, the coating liquid and the ferrite particles are placed in a vacuum-deaeration kneader, stirred while heated at 60° C. for 30 minute and deaerated for drying under heat and reduced pressure, to give a carrier. The specific volume resistivity of the carrier at an applied electric field of 1,000 V/cm is $10^{11}$ Ωcm.

<Preparation of Developer>

A ferrite carrier having an average diameter of 50 μm that is previously coated with polymethyl methacrylate (manufactured by Soken Chemical & Engineering Co.) in an amount of 1% and the toner A obtained are weighed in an amount corresponding to a toner concentration of 5 weight %, and the mixture is blended while stirred in a ball mill for 5 minutes, to give a developer A containing toner A.

[Actual Machine Evaluation]

The intermediate transfer belt A and the developer containing the toner A thus obtained are placed in DOCUCENTER C6550I manufactured by Fuji Xerox Co., Ltd., an image-forming apparatus in a type shown in FIG. 1, and the evaluation on graininess, white deletion, and cleaning defect is performed as described below. A4-sized J paper (manufactured by Fuji Xerox Office Supply) is used as the test paper.

(Evaluation of Graininess)

The graininess is evaluated as follows using three intermediate transfer belts arbitrarily picked up, A 20% magenta half-tone image is output and the images obtained are visually observed. Table 1 shows the result of the belt worst in evaluation.

The evaluation criteria for the graininess shown in Table 1 are as follows:

A: Favorable (satisfactory, smooth)

B: Slight graininess (allowable for practical purposes)

C: Moderate or severe graininess (unsatisfactory)

(Evaluation of White Deletion)

The white deletion is evaluated as follows using three intermediate transfer belts arbitrarily picked up. A 30% magenta half-tone image is output and the images obtained are visually observed as to whether there is white deletion caused by the belt. Table 1 shows the result of the belt worst in evaluation. The evaluation criteria for the white deletion shown in Table 1 are as follows:

A: No white deletion

C: Blurred or spotty white deletion is observed.

(Evaluation of Cleaning Defect)

The cleaning defect is evaluated as follows using three intermediate transfer belts arbitrarily picked up. 10% half-tone images in magenta, cyan, yellow, and black are output and the residual toner on the intermediate transfer belts in the width of the cleaning blade is determined. Table 1 shows the result of the belt worst in evaluation. The residual toner on the belt is regarded as cleaning defect. The evaluation criteria for the cleaning defect shown in Table 1 are as follows:

A: No cleaning defect

C: Cleaning defect is observed

Example A2

An intermediate transfer belt B is prepared in a manner similar to the intermediate transfer belt A, except that the polyaniline dispersion (B-1) for the intermediate transfer belt A is replaced with the following polyaniline dispersion (B-2). Actual machine evaluation is performed similarly to Example A1, except that the intermediate transfer belt B is used.

<Preparation of Polyaniline Dispersion (B-2)>

Polyaniline particles collected in a product-collecting unit 1 (Φ100 cyclone) among the polyaniline particles pulverized during preparation of the polyaniline dispersion (B-1) are used as second polyaniline particles, and part thereof was collected and dispersed in ethanol. Analysis of the particle size distribution of the second polyaniline particles shows a 50 percentile particle diameter (volume basis) of 2.7 μm, a 90 percentile particle diameter (volume basis) of 4.3 μm, and a 100 percentile particle diameter (volume basis) of 7.7 μm.

Then, 250 parts by weight of the pulverized second polyaniline particles and 25 parts by weight of PVP (polyvinylpyrrolidone) are added gradually to a dopant solution at a concentration of 5 weight %, in an amount corresponding to a predetermined doping amount with respect to 250 parts by weight of the polyaniline, under nitrogen atmosphere. The mixture is then stirred uniformly, to give a doped polyaniline dispersion (B-2).

Comparative Example A1

An intermediate transfer belt C is prepared in a manner similar to the intermediate transfer belt A, except that the polyaniline dispersion (B-1) used for the intermediate transfer belt A is replaced with the following polyaniline dispersion (B-3). It is evaluated in actual machine similarly to Example A1, except that the intermediate transfer belt C is used.

<Preparation of Polyaniline Dispersion (B-3)>

PANIPOL PA manufactured by Panipol is used as it is without pulverization. The PANIPOL PA is collected in a small amount and dispersed in ethanol. Analysis of the particle size distribution of the PANIPOL PA shows a 50 percentile particle diameter (volume basis) of 15.5 μm, a 90 percentile particle diameter (volume basis) of 25.3 μm, and a 100 percentile particle diameter (volume basis) of 48.5 μm.

Then, 25 parts by weight of PVP (polyvinylpyrrolidone) and 250 parts by weight of PANIPOL PA are added gradually to a dopant solution at a concentration of 5 weight %, in an amount corresponding to a predetermined doping amount with respect to 250 parts by weight of the polyaniline, under nitrogen atmosphere. The mixture is then stirred uniformly, to give a doped polyaniline dispersion (B-3).

Comparative Example A2

An intermediate transfer belt D is prepared in a manner similar to the intermediate transfer belt A, except that the polyaniline dispersion (B-1) used for the intermediate transfer belt A is replaced with the following polyaniline dispersion (b-1) and the solid weight ratio of polyaniline to polyamic acid PAn:PAA is changed to 10:90. It is evaluated in actual machine similarly to Example A1, except that the intermediate transfer belt D is used.

<Preparation of Polyaniline Dispersion (b-1)>

PANIPOL F manufactured by Panipol, a polyaniline in the dopes state (Emeraldine Salts), is pulverized in a similar manner to the polyaniline dispersion (B-1) in Example A1 in a counter jet mill (type 100AFG) manufactured by Hosokawamicron Co., Ltd.

Part of the polyaniline collected in the product-collecting unit 2 (P-bag) is dispersed in ethanol, and analysis of the particle size distribution of the polyaniline particles shows a 50 percentile particle diameter of 3.2 μm, a 90 percentile particle diameter of 7.4 μm, and a 100 percentile particle diameter of 30.2 μm.

Then under nitrogen atmosphere, 15 parts by weight of PVP (polyvinylpyrrolidone) is added to and stirred uniformly in 1,700 parts by weight of DMAc; 250 parts by weight of the pulverized PANIPOL F, a polyaniline in the doped state (Emeraldine Salts), is added gradually to the solution, to give a mixed liquid containing the polyaniline in the doped state at a concentration of 13 weight %. It is designated as doped polyaniline dispersion (b-1).

Comparative Example A3

An intermediate transfer belt E is prepared in a manner similar to the intermediate transfer belt A, except that the polyaniline dispersion (B-1) used for the intermediate transfer belt A is replaced with the following polyaniline dispersion (b-2). It is evaluated in actual machine similarly to Example A1, except that the intermediate transfer belt E is used.

<Preparation of Polyaniline Solution (b-2)>

250 Parts by weight of PANIPOL PA manufactured by Panipol is added gradually to and stirred uniformly in 1,700 parts by weight of DMAc solvent under nitrogen atmosphere, to give a polyaniline solution at a concentration of 13 weight %.

Then, a dopant (para-phenolsulfonic acid) is added to the DMAc solvent, and the mixture is stirred, to give a homogeneous dopant solution at a concentration of 5 weight %.

Since half of the PANIPOL PA by mole equivalence is doped, and thus, the dopant solution at a concentration of 5 weight % is added gradually in an amount corresponding to 60% with respect to 100% of the doped PANIPOL PA. The mixture is stirred uniformly, to give a doped polyaniline solution (b-2).

Example A3

An intermediate transfer belt F is prepared in a manner similar to the intermediate transfer belt A, except that the following operations are performed. It is evaluated in actual machine similarly to Example A1, except that the intermediate transfer belt F is used.

<Preparation of Self-Doped Polyaniline>

A conductive coating agent aquaPASS-01 (aqueous solution containing polyanilinesulfonic acid) manufactured by Mitsubishi Rayon Co., Ltd. is dried into powder, for example, by using an evaporator. The polyanilinesulfonic acid powder obtained (PAS; average molecular weight 10,000, average particle diameter approximately 9 μm) is used as self-doped polyaniline.

<Preparation of Polyanilinesulfonic Acid Dispersion (B-4)>

The self-doped polyaniline powder of polyanilinesulfonic acid is pulverized in a dry jet mill. The dry jet mill used is a counter jet mill (type 100AFG) manufactured by Hosokawamicron Co., Ltd.

The counter jet mill includes (1) a raw material-supplying unit FTS-20, (2) a counter jet mill 100AFG, (3) a product-collecting unit-1 (Φ100 cyclone), (4) a product-collecting unit-2 (P-bag, filtration area: 2.3 square meters), and (5) an exhaust blower. The main conditions of pulverization are as follows: pulverization air flow: 100 cubic meters per minute, air pressure: 600 kPa, and classification rotational velocity: 20,000 rpm.

The polyaniline collected then in the product-collecting unit 2 (P-bag) is designated as the third polyaniline particles, and a small amount thereof is dispersed in ethanol. Analysis of the particle size distribution of the third polyaniline particle shows a 50 percentile particle diameter (volume basis) of 1.8 μm, a 90 percentile particle diameter of 3.3 μm, and a 100 percentile particle diameter (volume basis) of 7.8 μm.

15 Parts by weight of PVP (polyvinylpyrrolidone) is added to 1,700 parts by weight of DMAc and stirred uniformly therein at room temperature (22° C.) under nitrogen atmosphere, and 250 parts by weight of powdery polyanilinesulfonic acid (PAS: the third polyaniline particle) is added gradually to the solution, to give a mixed liquid containing polyanilinesulfonic acid at 13 weight %. The liquid mixture is designated as polyanilinesulfonic acid dispersion (B-4).

<Preparation of Coating Liquid (C-2)>

The polyamic acid solution (A) and the polyanilinesulfonic acid dispersion (B-4) obtained by the method above are mixed uniformly, to give a coating liquid. Then, the ratio of the polyanilinesulfonic acid (PAS) to the polyamic acid (PAA) by solid weight PAS:PAA is 10:90. The mixture is adjusted to a viscosity suitable for coating by addition of DMAc solvent.

<Preparation of Endless Belt>

The coating liquid obtained is coated on the SUS surface of a cylindrical mold having an internal diameter of 365.5 mm and a length of 600 mm. The cylindrical mold is previously coated with a fluorine-based releasing agent on the surface for improvement of releasability of the belt after molding.

Then, the metal mold is subjected to drying at a temperature of 120° C. for 30 minutes while the mold is rotated. After drying, the mold is placed in an oven and baked at 320° C. for about 30 minutes, allowing progress of imide addition reaction.

After the mold was cooled at room temperature (22° C.), the resin is separated from the mold, to give an endless belt.

Both terminals of the endless belt obtained is cut, to give an intermediate transfer belt F having a circumferential length of 1,148 mm and a width of 369 mm. The thickness of the intermediate transfer belt is 0.08 mm.

Comparative Example A4

An intermediate transfer belt G is prepared in a similar manner to the intermediate transfer belt F, except that the polyanilinesulfonic acid dispersion (B-4) for the intermediate transfer belt F is replaced with the following polyanilinesulfonic acid dispersion (B-5). It is evaluated in actual machine similarly to Example A1, except that the intermediate transfer belt G is used.

<Preparation of Polyanilinesulfonic Acid Dispersion (B-5)>

The polyanilinesulfonic acid collected in the product-collecting unit 1 (Φ100 cyclone) in the polyanilinesulfonic acid pulverized during preparation of the polyanilinesulfonic acid dispersion (B-4) is designated as the fourth polyaniline particles, and part of it is dispersed in ethanol. Analysis of the particle size distribution of the fourth polyaniline particle shows a 50 percentile particle diameter (volume basis) of 3.0 μm, a 90 percentile particle diameter (volume basis) of 4.4 μm, and a 100 percentile particle diameter (volume basis) of 9.3 μm.

15 Parts by weight of PVP (polyvinylpyrrolidone) is added to 1,700 parts by weight of DMAc and stirred uniformly therein at room temperature (22° C.) under nitrogen atmosphere, and 250 parts by weight of the fourth polyaniline particles are added gradually to the solution, to give a mixed liquid containing polyanilinesulfonic acid at 13 weight %. The liquid mixture is designated as polyanilinesulfonic acid dispersion (B-5).

Comparative Example A 5

An intermediate transfer belt H is prepared in a similar manner to the intermediate transfer belt F, except that the polyanilinesulfonic acid dispersion (B-4) for the intermediate transfer belt F is replaced with the following polyanilinesulfonic acid dispersion (B-6). It is evaluated in actual machine similarly to Example A1, except that the intermediate transfer belt H is used.

<Preparation of Polyanilinesulfonic Acid Dispersion (B-6)>

15 Parts by weight of PVP (polyvinylpyrrolidone) is added to 1,700 parts by weight of DMAc and stirred uniformly therein at room temperature (22° C.) under nitrogen atmosphere, and 250 parts by weight of powdery polyanilinesulfonic acid (PAS) is added gradually to the solution, to give a mixed liquid containing polyanilinesulfonic acid at 13 weight %. It is designated as polyanilinesulfonic acid dispersion (B-6). Analysis of the particle size distribution of the polyanilinesulfonic acid particles in polyanilinesulfonic acid dispersion (B-6) shows a 50 percentile particle diameter of 7.9 μm, a 90 percentile particle diameter of 12.2 μm, and a 100 percentile particle diameter of 29.9 μm.

Results of measurement and evaluation in the Examples and Comparative Examples described above are summarized in the following Tables 1 and 2. The particle size distribution (50 percentile particle diameter and 90 percentile particle diameter) of the pulverized polyaniline used in the production process for the intermediate transfer belt, the particle size distribution (50 percentile particle diameter and 90 percentile particle diameter) of the toner, the method of coating the polyimide resin, and others are also shown in Tables 1 and 2.

TABLE 1

| Table 1 (toner A) | | | Example A1 Intermediate transfer belt A Dispersion: B-1 | | Example A2 Intermediate transfer belt B Dispersion: B-2 | | Comparative Example A1 Intermediate transfer belt C Dispersion: B-3 | | Comparative Example A2 Intermediate transfer belt D Dispersion: b-1 | | Comparative Example A3 Intermediate transfer belt E Solution: b-2 | |
|---|---|---|---|---|---|---|---|---|---|---|---|---|
| Belt | Composition of coating liquid | Volume basis 50 and 90 percentile particle diameters (μm) | 1.4, 2.4 | | 2.7, 4.3 | | 15.5, 25.3 | | 3.2, 7.4 | | Solution (with some gel) | |
| | | Solid weight ratio (PAn:PAA) | 12:88 | | 12:88 | | 12:88 | | 10:90 | | 18:82 | |
| | Coating method | Coating method | (B) Cylindrical mold coating | | (B) Cylindrical mold coating | | (B) Cylindrical mold coating | | (B) Cylindrical mold coating | | (B) Cylindrical mold coating | |
| | Polyaniline particles in belt | Absolute maximum length of largest polyaniline particle (μm) | 6.6 | | 8.3 | | 47.1 | | 33.1 | | 12.4 | |
| | | Number basis 50 and 90 percentile particles diameters (μm) | 1.5, 2.5 | | 3.0, 4.7 | | 10.2, 16.4 | | 3.5, 8.1 | | not measured | |
| | | Number basis 90 percentile particle diameter/50 percentile particle diameter | 1.67 | | 1.57 | | 1.61 | | 2.31 | | not measured | |
| | Yield | Number of samples with acceptable appearance | A | 19 | B | 18 | C | 13 | C | 15 | C | 14 |
| | Electrical properties | Surface resistivity (logΩ/□) | A | 12.2 ± 0.1 | A | 12.2 ± 0.1 | B | 12.2 ± 0.2 | B | 12.1 ± 0.2 | A | 12.1 ± 0.1 |
| | | Volume resistivity (logΩ cm) | A | 11.8 ± 0.1 | B | 11.8 ± 0.2 | C | 11.9 ± 0.3 | B | 11.7 ± 0.2 | A | 11.4 ± 0.1 |
| | Surface physical properties | Surface roughness Ra (μm) | A | 0.025-0.035 | B | 0.056-0.064 | C | 0.082-0.088 | C | 0.081-0.086 | A | 0.025-0.035 |
| | | Micro-glossiness 75° (gloss units) | A | 107-112 | A | 98-104 | C | 85-91 | C | 87-93 | A | 102-109 |
| | | Sharpness (reflectivity of grid pattern) | A | Very small grid deformation and definite thin grid line | B | Very small grid deformation and medium-thickness bleeding grid line | C | Small grid deformation and bleeding thick grid line | C | Small grid deformation and bleeding thick grid line | A | Very small grid deformation and definite thin grid line |
| Toner | Toner A | Number basis 10, 50 and 90 percentile particle diameters | 4.8, 6.3, 7.9 | | 4.8, 6.3, 7.9 | | 4.8, 6.3, 7.9 | | 4.8, 6.3, 7.9 | | 4.8, 6.3, 7.9 | |
| | Particle diameter condition | Number basis (PAn 50 percentile particle diameter × 2) ≦ (toner 50 percentile particle diameter) | Yes | 3.0 < 6.3 | Yes | 6.0 < 6.3 | No | 20.4 > 6.3 | No | 7.0 > 6.3 | — | not measured |

TABLE 1-continued

| Table 1 (toner A) | | Example A1 Intermediate transfer belt A Dispersion: B-1 | | Example A2 Intermediate transfer belt B Dispersion: B-2 | | Comparative Example A1 Intermediate transfer belt C Dispersion: B-3 | | Comparative Example A2 Intermediate transfer belt D Dispersion: b-1 | | Comparative Example A3 Intermediate transfer belt E Solution: b-2 | |
|---|---|---|---|---|---|---|---|---|---|---|---|
| | Number basis (PAn 90 percentile particle diameter) < (toner 10 percentile particle diameter) | Yes | 2.5 < 4.8 | Yes | 4.7 < 4.8 | No | 16.4 > 4.8 | No | 8.1 > 4.8 | — | not measured |
| Evalution of transferred image | Graininess | A | Favorable (smooth) | B | slight graininess | C | severe graininess | C | severe graininess | A | Favorable (smooth) |
| | White deletion (M30% H/T) | A | None | A | None | C | Present (severe blurring) | C | Present (severe blurring) | C | Present (white spotty) |
| | Cleaning defect | A | None | A | None | C | Present | C | Present | A | None |
| | Overall evaluation | | A | | B | | C | | C | | C |

TABLE 2

| Table 2 (toner A) | | | Example A3 Intermediate transfer belt F Dispersion: B-4 | | Example A4 Intermediate transfer belt G Dispersion: B-5 | | Comparative Example A5 Intermediate transfer belt H Dispersion: B-6 | |
|---|---|---|---|---|---|---|---|---|
| Belt | Composition of coating liquid | Volume basis 50 and 90 percentile particle diameters (μm) | 1.8, 3.3 | | 3.0, 4.4 | | 7.9, 12.2 | |
| | | Solid weight ratio (PAn:PAA) | 10:90 | | 10:90 | | 10:90 | |
| | Coating method | Coating method | (B) Cylindrical mold coating | | (B) Cylindrical mold coating | | (B) Cylindrical mold coating | |
| | Polyaniline particles in belt | Absolute maximum length of largest polyaniline particle (μm) | 8.1 | | 9.7 | | 32.1 | |
| | | Number basis 50 and 90 percentile particle diameters (μm) | 2.0, 3.6 | | 3.2, 4.9 | | 8.2, 12.9 | |
| | | Number basis 90 percentile particle diameter/50 percentile particle diameter | 1.80 | | 1.53 | | 1.57 | |
| | Yield | Number of samples with acceptable appearance | A | 19 | B | 17 | C | 15 |
| | Electrical properties | Surface resistivity (logΩ/□) | A | 12.2 ± 0.1 | A | 12.2 ± 0.1 | B | 12.1 ± 0.2 |
| | | Volume resistivity (logΩ cm) | A | 11.8 ± 0.1 | B | 11.8 ± 0.2 | B | 11.7 ± 0.2 |
| | Surface physical properties | Surface roughness Ra (μm) | A | 0.027-0.038 | B | 0.058-0.066 | C | 0.078-0.085 |
| | | Micro-glossiness 75° (gloss units) | A | 101-106 | A | 96-102 | C | 88-94 |
| | | Sharpness (reflectivity of grid pattern) | A | Very small grid deformation and definite thin grid line | B | Very small grid deformation and medium-thickness bleeding grid line | C | Small grid deformation and bleeding thick grid line |
| Toner | Toner A | Number basis 10th, 50 and 90 percentile particle diameters | 4.8, 6.3, 7.9 | | 4.8, 6.3, 7.9 | | 4.8, 6.3, 7.9 | |
| | Particle diameter condition | Number basis (PAn 50 percentile particle diameter × 2) ≦ (toner 50 percentile particle diameter) | Yes | 4.0 < 6.3 | No | 6.4 > 6.3 | No | 16.4 > 6.3 |
| | | Number basis (PAn 90 percentile particle diameter) < (toner 10 percentile particle diameter) | Yes | 3.6 < 4.8 | No | 4.9 > 4.8 | No | 12.9 > 4.8 |

TABLE 2-continued

| Table 2 (toner A) | | Example A3 Intermediate transfer belt F Dispersion: B-4 | | Example A4 Intermediate transfer belt G Dispersion: B-5 | | Comparative Example A5 Intermediate transfer belt H Dispersion: B-6 | |
|---|---|---|---|---|---|---|---|
| Evaluation of transferred image | Graininess | A | Favorable (smooth) | C | moderate graininess | C | severe graininess |
| | White deletion (M30% H/T) | A | None | B | Present (slight blurring) | C | Present (severe blurring) |
| | Cleaning defect | A | None | A | None | C | Present |
| | Overall evaluation | A | | C | | C | |

Examples B1 to B3 and Comparative Example B1 to B5

An actual machine evaluation is performed in a similar manner to Example A1, except that the developer containing toner B prepared as described below according to Tables 3 and 4 and an intermediate transfer belt A to H are used.

The results of measurement and evaluation in Examples and Comparative Examples are summarized in Tables 3 and 4. The particle size distribution (50 percentile particle diameter and 90 percentile particle diameter) of the pulverized polyaniline used in the preparative process for the intermediate transfer belt, the particle size distribution (50 percentile particle diameter and 90 percentile particle diameter) of the toner, the method of coating the polyimide resin, and others are also shown in Tables 3 and 4.

[Preparation of Developer]

A developer containing toner B is prepared in a similar manner to the developer containing toner A, except the followings: First, components similar to those for the toner A except that the amount of aluminum sulfate (manufactured by Wako Pure Chemical Industries) used is changed from 1.5 parts to 1.1 parts are placed in a round stainless steel flask with a jacket for temperature regulation; and the mixture is dispersed with a homogenizer (ULTRA-TURRAX T50 manufactured by IKA) at 5,000 rpm for 5 minutes, transferred into a separate flask, and left while stirred with a four-blade paddle at 25° C. for 20 minutes. The mixture is then heated at a heating rate of 1° C./minute to an internal temperature of 50° C. with a mantle heater and kept at 50° C. for 20 minutes. Then, 80 parts of the resin particle dispersion is added gently; and the mixture is left at 50° C. for 30 minutes and adjusted to pH 6.5 by addition of aqueous 1 N sodium hydroxide solution.

Then, the mixture is heated at a heating rate of 1° C./minute to 95° C. and kept at the same temperature for 30 minutes. The mixture is adjusted to pH 4.8 by addition of aqueous 0.1 N nitric acid solution and left at 95° C. for 2 hours. Then, the aqueous 1 N sodium hydroxide solution is added additionally, to make pH 6.5, and the mixture is left at 95° C. for 4.7 hours. The mixture is then cooled at a rate of 1° C./minute to 30° C.

The toner particle dispersion obtained is filtered; (A) 2,000 parts of ion-exchange water at 35° C. is added to the toner particle obtained; and (B) the mixture is stirred for 20 minutes and then (C) filtered. The operations (A) to (C) are repeated for five times, and the toner particles on filter paper is transferred into a vacuum dryer and dried at 45° C. at a pressure of 1,000 Pa or less for 10 hours. The pressure is kept 1,000 Pa or less, because the toner particles described above are in the wet state, water therein is frozen even at 45° C. in the initial drying stage, and then sublimates, and thus the internal pressure of the drier under reduced pressure may be fluctuated. However, the internal pressure is stabilized at 100 Pa at the end of the drying. After the drier is back under atmospheric pressure, the particles are taken out, to give a toner B.

TABLE 3

| Table 3 (toner-B) | | | Example B1 Intermediate transfer belt A Dispersion: B-1 | Example B2 Intermediate transfer belt B Dispersion: B-2 | Comparative Example B1 Intermediate transfer belt C Dispersion: B-3 | Comparative Example B2 Intermediate transfer belt D Dispersion: b-1 | Comparative Example B3 Intermediate transfer belt E Solution: b-2 |
|---|---|---|---|---|---|---|---|
| Belt | Composition of coating liquid | Volume basis 50 and 90 percentile particle diameters (μm) | 1.4, 2.4 | 2.7, 4.3 | 15.5, 25.3 | 3.2, 7.4 | Solution (with some gel) |
| | | Solid weight ratio (PAn:PAA) | 12:88 | 12:88 | 12:88 | 10:90 | 18:82 |
| | Coating method | Coating method | (B) Cylindrical mold coating | (B) Cylindrical mold coating | (B) Cylindrical mold coating | (B) Cylindrical mold coating | (B) Cylindrical mold coating |
| | Polyaniline particles in belt | Absolute maximum length of largest polyaniline particle (μm) | 6.6 | 8.3 | 47.1 | 33.1 | 12.4 |
| | | Number basis 50 and 90 percentile particle diameters (μm) | 1.5, 2.5 | 3.0, 4.7 | 10.2, 16.4 | 3.5, 8.1 | not measured |
| | | Number basis 90 percentile particle diameter/50 percentile particle diameter | 1.67 | 1.57 | 1.61 | 2.31 | not measured |

TABLE 3-continued

| Table 3 (toner-B) | | | Example B1 Intermediate transfer belt A Dispersion: B-1 | | Example B2 Intermediate transfer belt B Dispersion: B-2 | | Comparative Example B1 Intermediate transfer belt C Dispersion: B-3 | | Comparative Example B2 Intermediate transfer belt D Dispersion: b-1 | | Comparative Example B3 Intermediate transfer belt E Solution: b-2 | |
|---|---|---|---|---|---|---|---|---|---|---|---|---|
| | Yield | Number of samples with acceptable appearance | A | 19 | B | 18 | C | 13 | C | 15 | C | 14 |
| | Electrical properties | Surface resistivity (logΩ/□) | A | 12.2 ± 0.1 | A | 12.2 ± 0.1 | B | 12.2 ± 0.2 | B | 12.1 ± 0.2 | A | 12.1 ± 0.1 |
| | | Volume resistivity (logΩ cm) | A | 11.8 ± 0.1 | B | 11.8 ± 0.2 | C | 11.9 ± 0.3 | B | 11.7 ± 0.2 | A | 11.4 ± 0.1 |
| | Surface physical properties | Surface roughness Ra (μm) | A | 0.025-0.035 | B | 0.056-0.064 | C | 0.082-0.088 | C | 0.081-0.086 | A | 0.025-0.035 |
| | | Micro-glossiness 75° (gloss units) | A | 107-112 | A | 98-104 | C | 85-91 | C | 87-93 | A | 102-109 |
| | | Sharpness (reflectivity of grid pattern) | A | Very small grid deformation and definite thin grid line | B | Very small grid deformation and medium-thickness bleeding grid line | C | Small grid deformation and bleeding thick grid line | C | Small grid deformation and bleeding thick grid line | A | Very small grid deformation and definite thin grid line |
| Toner | Toner B 10, 50 and 90 percentile particle diameters | Number basis | 4.1, 6.1, 8.5 | | 4.1, 6.1, 8.5 | | 4.1, 6.1, 8.5 | | 4.1, 6.1, 8.5 | | 4.1, 6.1, 8.5 | |
| Particle diameter condition | | Number basis (PAn 50 percentile particle diameter × 2) ≦ (toner 50 percentile particle diameter) | Yes | 3.0 < 6.1 | Yes | 6.0 < 6.1 | No | 20.4 > 6.1 | No | 7.0 > 6.1 | — | not measured |
| | | Number basis (PAn 90 percentile particle diameter) < (toner 10 percentile particle diameter) | Yes | 2.5 < 4.1 | No | 4.7 > 4.1 | No | 16.4 > 4.1 | No | 8.1 > 4.1 | — | not measured |
| Evaluation of transferred image | | Graininess | A | Favorable (smooth) | B | slight graininess | C | severe graininess | C | severe graininess | A | Favorable (smooth) |
| | | White deletion (M30% H/T) | A | None | B | Present (slight blurring) | C | Present (severe blurring) | C | Present (slight blurring) | C | Present (white spotty) |
| | | Cleaning defect | A | None | A | None | C | Present | C | Present | A | None |
| | | Overall evaluation | | A | | B | | C | | C | | C |

TABLE 4

| Table 4 (toner-B) | | | Example B3 Intermediate transfer belt F Dispersion: B-4 | Comparative Example B4 Intermediate transfer belt G Dispersion: B-5 | Comparative Example B5 Intermediate transfer belt H Dispersion: B-6 |
|---|---|---|---|---|---|
| Belt | Composition of coating liquid | Volume basis 50 and 90 percentile particle diameters (μm) | 1.8, 3.3 | 3.0, 4.4 | 7.9, 12.2 |
| | | Solid weight ratio (PAn:PAA) | 10:90 | 10:90 | 10:90 |
| | Coating method | Coating method | (B) Cylindrical mold coating | (B) Cylindrical mold coating | (B) Cylindrical mold coating |
| | Polyaniline particles in belt | Absolute maximum length of largest polyaniline particle (μm) | 8.1 | 9.7 | 32.1 |
| | | Number basis 50 and 90 percentile particle diameters (μm) | 2.0, 3.6 | 3.2, 4.9 | 8.2, 12.9 |
| | | Number basis 90 percentile particle diameter/50 percentile particle diameter | 1.80 | 1.57 | 1.57 |

TABLE 4-continued

| Table 4 (toner-B) | | Example B3 Intermediate transfer belt F Dispersion: B-4 | | Comparative Example B4 Intermediate transfer belt G Dispersion: B-5 | | Comparative Example B5 Intermediate transfer belt H Dispersion: B-6 | |
|---|---|---|---|---|---|---|---|
| Yield | Number of samples with acceptable appearance | A | 19 | B | 17 | C | 15 |
| Electrical properties | Surface resistivity (logΩ/□) | A | 12.2 ± 0.1 | A | 12.2 ± 0.1 | B | 12.1 ± 0.2 |
| | Volume resistivity (logΩ cm) | A | 11.8 ± 0.1 | B | 11.8 ± 0.2 | B | 11.7 ± 0.2 |
| Surface physical properties | Surface roughness Ra (μm) | A | 0.027-0.038 | B | 0.058-0.066 | C | 0.078-0.085 |
| | Micro-glossiness 75° (gloss units) | A | 101-106 | A | 96-102 | C | 88-94 |
| | Sharpness (reflectivity of grid pattern) | A | Very small grid deformation and definite thin grid line | B | Very small grid deformation and medium-thickness bleeding grid line | C | Small grid deformation and bleeding thick grid line |
| Toner Toner B | Number basis 10, 50 and 90 percentile particle diameters | 4.1, 6.1, 8.5 | | 4.1, 6.1, 8.5 | | 4.1, 6.1, 8.5 | |
| Particle diameter condition | Number basis (PAn 50 percentile particle diameter × 2) ≦ (toner 50 percentile particle diameter) | Yes | 4.0 < 6.1 | No | 6.4 > 6.1 | No | 16.4 > 6.1 |
| | Number basis (PAn 90 percentile particle diameter) < (toner 10 percentile particle diameter) | Yes | 3.6 < 4.1 | No | 4.9 > 4.1 | No | 12.9 > 4.1 |
| Evaluation of transferred image | Graininess | A | Favorable (smooth) | C | moderate graininess | C | severe graininess |
| | White deletion (M30% H/T) | A | None | B | Present (slight blurring) | C | Present (severe blurring) |
| | Cleaning defect | A | None | A | None | C | Present |
| | Overall evaluation | A | | C | | C | |

Examples C1 to C2 and Comparative Examples C1 to C6

Actual machine evaluation is performed in a similar manner to Example A1, except that the developer containing toner C prepared as described below according to Tables 5 and 6 and an intermediate transfer belt A to H are used.

The results of measurement and evaluation in Examples and Comparative Examples are summarized in Tables 5 and 6. The particle size distribution (50 percentile particle diameter and 90 percentile particle diameter) of the pulverized polyaniline used in the preparative process for the intermediate transfer belt, the particle size distribution (50 percentile particle diameter and 90 percentile particle diameter) of the toner, the method of coating the polyimide resin, and others are also shown in Tables 5 and 6.

[Preparation of Developer]

A developer containing toner C is prepared in a similar manner to the developer containing toner A, except the followings:

First, components similar to those for the toner A are placed in a round stainless steel flask with a jacket for temperature regulation; and the mixture is dispersed with a homogenizer (ULTRA-TURRAX T50 manufactured by IKA) at 5,000 rpm for 5 minutes, transferred into a separate flask, and left while stirred with a four-blade paddle at 25° C. for 20 minutes. The mixture is then heated at a heating rate of 1° C./minute to an internal temperature of 40° C. with a mantle heater and kept at 40° C. for 20 minutes. Then, 80 parts of the resin particle dispersion is added gently; and the mixture is left at 40° C. for 30 minutes and adjusted to pH 6.5 by addition of aqueous 1 N sodium hydroxide solution.

Then, the mixture is heated at a heating rate of 1° C./minute to 95° C. and kept at the same temperature for 30 minutes. The mixture is adjusted to pH 4.8 by addition of aqueous 0.1 N nitric acid solution and left at 95° C. for 2 hours. Then, the aqueous 1 N sodium hydroxide solution above is added additionally, to make the pH 6.5, and the mixture is left at 95° C. for 4.7 hours. The mixture is then cooled at a rate of 10° C./minute to 30° C.

The toner particle dispersion obtained is filtered; (A) 2,000 parts of ion-exchange water at 35° C. is added to the toner particle obtained; and (B) the mixture is stirred for 20 minutes, and then (C) filtered. The operations (A) to (C) are repeated for five times, and the toner particles on filter paper is transferred into a vacuum dryer and dried at 45° C. at a pressure of 1,000 Pa or below for 10 hours. The pressure is kept 1,000 Pa or below, because the toner particles described above are in the wet state, water therein is frozen even at 45° C. in the initial drying stage, and then sublimates, and thus the internal pressure of the drier under reduced pressure may be fluctuated. However, the internal pressure is stabilized at 100 Pa at the end of the drying. After the drier is back under atmospheric pressure, the particles are taken out, to give a toner C.

TABLE 5

| Table 5 (toner-C) | | | Example C1 Intermediate transfer belt A Dispersion: B-1 | | Comparative Example C1 Intermediate transfer belt B Dispersion: B-2 | | Comparative Example C2 Intermediate transfer belt C Dispersion: B-3 | | Comparative Example C3 Intermediate transfer belt D Dispersion: b-1 | | Comparative Example C4 Intermediate transfer belt E Solution: b-2 | |
|---|---|---|---|---|---|---|---|---|---|---|---|---|
| Belt | Composition of coating liquid | Volume basis 50 and 90 percentile particle diameters (μm) | | 1.4, 2.4 | | 2.7, 4.3 | | 15.5, 25.3 | | 3.2, 7.4 | | Solution (with some gel) |
| | | Solid weight ratio (PAn:PAA) | | 12:88 | | 12:88 | | 12:88 | | 10:90 | | 18:82 |
| | Coating method | Coating method | | (B) Cylindrical mold coating | | (B) Cylindrical mold coating | | (B) Cylindrical mold coating | | (B) Cylindrical mold coating | | (B) Cylindrical mold coating |
| | Polyaniline particles in belt | Absolute maximum length of largest polyaniline particle (μm) | | 6.6 | | 8.3 | | 47.1 | | 33.1 | | 12.4 |
| | | Number basis 50 and 90 percentile particle diameters (μm) | | 1.5, 2.5 | | 3.0, 4.7 | | 10.2, 16.4 | | 3.5, 8.1 | | Not measured |
| | | Number basis 90 percentile particle diameter/50 percentile particle diameter | | 1.67 | | 1.57 | | 1.61 | | 2.31 | | Not measured |
| | Yield | Number of samples with acceptable appearance | A | 19 | B | 18 | C | 13 | C | 15 | C | 14 |
| | Electical properties | Surface resistivity (logΩ/□) | A | 12.2 ± 0.1 | A | 12.2 ± 0.1 | B | 12.2 ± 0.2 | B | 12.1 ± 0.2 | A | 12.1 ± 0.1 |
| | | Volume resistivity (logΩ cm) | A | 11.8 ± 0.1 | B | 11.8 ± 0.2 | C | 11.9 ± 0.3 | B | 11.7 ± 0.2 | A | 11.4 ± 0.1 |
| | Surface physical properties | Surface roughness Ra (μm) | A | 0.025-0.035 | B | 0.056-0.064 | C | 0.082-0.088 | C | 0.081-0.086 | A | 0.025-0.035 |
| | | Micro-glossiness 75° (gloss units) | A | 107-112 | A | 98-104 | C | 85-91 | C | 87-93 | A | 102-109 |
| | | Sharpness (reflectivity of grid pattern) | A | Very small grid deformation and definite thin grid line | B | Very small grid deformation and medium-thickness bleeding grid line | C | Small grid deformation and bleeding thick grid line | C | Small grid deformation and bleeding thick grid line | A | Very small grid deformation and definite thin grid line |
| Toner | Toner C | Number basis 10, 50 and 90 percentile particle diameters | | 2.8, 4.7, 7.7 | | 2.8, 4.7, 7.7 | | 2.8, 4.7, 7.7 | | 2.8, 4.7, 7.7 | | 2.8, 4.7, 7.7 |
| | Particle diameter condition | Number basis (PAn 50 percentile particle diameter × 2) ≦ (toner 50 percentile particle diameter) | Yes | 3.0 < 4.7 | No | 6.0 > 4.7 | No | 20.4 > 4.7 | No | 7.0 > 4.7 | — | Not measured |
| | | Number basis (PAn 90 percentile particle diameter) < (toner 10 percentile particle diameter) | Yes | 2.5 < 2.8 | No | 4.7 > 2.8 | No | 16.4 > 2.8 | No | 8.1 > 2.8 | — | Not measured |
| | Evaluation of transferred image | Graininess | A | Favorable (smooth) | C | moderate graininess | C | severe graininess | C | severe graininess | A | Favorable (smooth) |
| | | White deletion (M30% H/T) | A | None | B | Present (slight blurring) | C | Present (slight blurring) | C | Present (severe blurring) | C | Present (white spotty) |
| | | Cleaning defect | A | None | A | None | C | Present | C | Present | A | None |
| | | Overall evaluation | | A | | C | | C | | C | | C |

TABLE 6

| Table 6 (toner-C) | | | Example C2 Intermediate transfer belt F Dispersion: B-4 | Comparative Example C5 Intermediate transfer belt G Dispersion: B-5 | Comparative Example C6 Intermediate transfer belt H Dispersion: B-6 |
|---|---|---|---|---|---|
| Belt | Composition of coating liquid | Volume basis 50 and 90 percentile particle diameters (μm) | 1.8, 3.3 | 3.0, 4.4 | 7.9, 12.2 |
| | | Solid weight ratio (PAn:PAA) | 10:90 | 10:90 | 10:90 |

TABLE 6-continued

| Table 6 (toner-C) | | | Example C2 Intermediate transfer belt F Dispersion: B-4 | | Comparative Example C5 Intermediate transfer belt G Dispersion: B-5 | | Comparative Example C6 Intermediate transfer belt H Dispersion: B-6 | |
|---|---|---|---|---|---|---|---|---|
| | Coating method | Coating method | (B) Cylindrical mold coating | | (B) Cylindrical mold coating | | (B) Cylindrical mold coating | |
| | Polyaniline particles in belt | Absolute maximum length of largest polyaniline particle (μm) | 8.1 | | 9.7 | | 32.1 | |
| | | Number basis 50 and 90 percentile particle diameters (μm) | 2.0, 3.6 | | 3.2, 4.9 | | 8.2, 12.9 | |
| | | Number basis 90 percentile particle diameter/50 percentile particle diameter | 1.80 | | 1.57 | | 1.57 | |
| | Yield | Number of samples with acceptable appearance | A | 19 | B | 17 | C | 15 |
| | Electrical properties | Surface resistivity (logΩ/□) | A | 12.2 ± 0.1 | A | 12.2 ± 0.1 | B | 12.1 ± 0.2 |
| | | Volume resistivity (logΩ cm) | A | 11.8 ± 0.1 | B | 11.8 ± 0.2 | B | 11.7 ± 0.2 |
| | Surface physical properties | Surface roughness Ra (μm) | A | 0.027-0.038 | B | 0.058-0.066 | C | 0.078-0.085 |
| | | Micro-glossiness 75° (gloss units) | A | 101-106 | A | 96-102 | C | 88-94 |
| | | Sharpness (reflectivity of grid pattern) | A | Very small grid deformation and definite thin grid line | B | Very small grid deformation and medium-thickness bleeding grid line | C | Small grid deformation and bleeding thick grid line |
| Toner | Toner C | Number basis 10, 50 and 90 percentile particle diameters | 2.8, 4.7, 7.7 | | 2.8, 4.7, 7.7 | | 2.8, 4.7, 7.7 | |
| | Particle diameter condition | Number basis (PAn 50 percentile particle diameter × 2) ≦ (toner 50 percentile particle diameter) | Yes | 4.0 < 4.7 | No | 6.4 > 4.7 | No | 16.4 > 4.7 |
| | | Number basis (PAn 90 percentile particle diameter) < (toner 10 percentile particle diameter) | No | 3.6 > 2.8 | No | 4.9 > 2.8 | No | 12.9 > 2.8 |
| | Evaluation of transferred image | Graininess | A | Favorable (smooth) | C | moderate graininess | C | severe graininess |
| | | White deletion (M30% H/T) | B | Present (slight blurring) | B | Present (slight blurring) | C | Present (severe blurring) |
| | | Cleaning defect | A | None | A | None | C | Present |
| | | Overall evaluation | | B | | C | | C |

Examples D1 to D6

Actual machine evaluation is performed in a similar manner to Example A1, except that the developer containing toner A obtained in Example A1 and the intermediate transfer belt I to N prepared as described below according to Tables 7 and 8 are used.

[Preparation of Intermediate Transfer Belt I]

<Preparation of Polyamic Acid Solution (A-2)>

4,4'-Diaminodiphenylether (ODA) is dissolved in DMAc solvent; 3,3',4,4'-biphenyltetracarboxylic dianhydride (BPDA) is added thereto; and the mixture is stirred thoroughly under nitrogen atmosphere. The ratio of ODA:BPDA is adjusted to 1.00:1.00 by mole, to give a polyamic acid solution (A-2) at a concentration of 20 weight %.

<Preparation of Coating Liquid (C-3)>

The polyamic acid solution (A-2), a filler (tin oxide), and DMAc solvent additionally are added to the doped polyaniline dispersion (B-1) obtained by the method described above, and the mixture is stirred thoroughly and deaerated, to give a coating liquid (C-3). The viscosity of the coating liquid (C-3) is adjusted to 20 to 40 Pa·s.

The solid weight ratio of the doped polyaniline (PAn) and the polyamic acid (PAA) to the filler (tin oxide) in the coating liquid (C-3), PAn:PAA:tin oxide, is 10.8:79.2:10.0.

The tin oxide used as the filler is a metal oxide, antimony-doped tin oxide doped (hereinafter, referred to simply as "tin oxide") having a specific gravity of 7.0 g/ml.

<Preparation of Endless Belt>

The coating liquid obtained is coated on the external surface of a SUS cylindrical mold having an external diameter of 365.5 mm and a length of 600 mm, and excessive coating liquid was scraped off with a film thickness-control mold moving in parallel with the cylindrical metal mold, to control the thickness of the coating liquid on the cylindrical mold.

Then, the coated film is dried at a temperature of 120° C. for 30 minutes while the mold is rotated. After drying, the mold is placed in an open and baked at 320° C. for about 30 minutes, allowing progress of imide addition reaction.

After the mold is cooled at room temperature (22° C.), the resin is separated from the mold, to give an endless belt.

Two endless belts thus prepared are each cut along the metal-mold length direction, and the two belts are connected to each other, forming a sheet. The belts are connected, for example, according to the puzzle-cut seaming method described in JP-A No. 0.2000-145895. The sheet is cut into a piece having a width of 362 mm, and both ends are puzzle-cut seamed, to give an endless belt having a width of 362 mm and a length of 2,111 mm. It is designated as intermediate transfer belt I. The thickness of the intermediate transfer belt is 0.08 mm.

[Preparation of Intermediate Transfer Belt J]

An intermediate transfer belt J is prepared in a similar manner to the intermediate transfer belt I, except that the filler tin oxide for the intermediate transfer belt I is replaced with titanium oxide and the solid weight ratio of the doped polyaniline (PAn) and the polyamic acid (PAA) to the filler (titanium oxide) in the coating liquid (C-3), PAn:PAA:titanium oxide, is changed to 10.1:79.9:10.0. The titanium oxide used as the filler is an metal oxide, antimony-doped titanium oxide (hereinafter, referred to as "titanium oxide") having a specific gravity of 5.0 g/ml.

[Preparation of Intermediate Transfer Belt K]

An intermediate transfer belt K is prepared in a similar manner to the intermediate transfer belt I, except that the polyamic acid solution (A-2) for intermediate transfer belt I is replaced with the following polyamic acid solution (A-3).

<Preparation of Polyamic Acid Solution (A-3)>

4,4'-Diaminodiphenylether (ODA) is dissolved in DMAc solvent; 3,3',4,4'-biphenyltetracarboxylic dianhydride (BPDA) and pyromellitic dianhydride (PMDA) are added thereto; and the mixture is stirred thoroughly under nitrogen atmosphere. The ratio of ODA:BPDA:PMDA is adjusted to 1.00:0.80:0.20, to give a polyamic acid solution (A-3) at a concentration of 20 weight %.

[Preparation of Intermediate Transfer Belt L]

An intermediate transfer belt L is prepared in a similar manner to the intermediate transfer belt I, except that the polyamic acid solution (A-2) used for intermediate transfer belt I is replaced with the polyamic acid solution (A-3) and the solid weight ratio of the doped polyaniline (PAn) and the polyamic acid (PAA) to the filler (tin oxide) in the coating liquid (C-3), PAn:PAA:tin oxide, is changed to 10.8:74.2:15.0.

[Preparation of Intermediate Transfer Belt M]

An intermediate transfer belt M is prepared in a similar manner to the intermediate transfer belt I, except that the polyamic acid solution (A-2) used for intermediate transfer belt I is replaced with the polyamic acid solution (A-4) and the solid weight ratio of the doped polyaniline (PAn) and the polyamic acid (PAA) to the filler (tin oxide) in the coating liquid (C-3), PAn:PAA:tin oxide, is changed to 10.1:74.9:15.0.

<Preparation of Polyamic Acid Solution (A-4)>

4,4'-Diaminodiphenylether (ODA) is dissolved in DMAc solvent; 3,3',4,4'-biphenyltetracarboxylic dianhydride (BPDA) and pyromellitic dianhydride (PMDA) are added thereto; and the mixture is stirred thoroughly under nitrogen atmosphere. The ratio of ODA:BPDA:PMDA is adjusted to 1.00:0.55:0.45 by mole, to give a polyamic acid solution (A-4) at a concentration of 20 weight %.

[Preparation of Intermediate Transfer Belt N]

An intermediate transfer belt N is prepared in a similar manner to the intermediate transfer belt I, except that the polyamic acid solution (A-2) used for intermediate transfer belt I is replaced with the polyamic acid solution (A-4) and the solid weight ratio of the doped polyaniline (PAn) and the polyamic acid (PAA) to the filler (titanium oxide) in the coating liquid (C-3), PAn:PAA:tin oxide, is changed to 10.1:74.9:15.0.

[Evaluation]

The "absolute maximum length of largest polyaniline particle", the "particle size distribution (number basis) of the polyaniline particles" in each of the intermediate transfer belts I to N are determined in a manner similar to the intermediate transfer belt A, and in addition, the "absolute maximum length of the largest filler particle" is determined by the following method. Specifically, the "absolute maximum length of the largest filler particle" is determined, similarly to the case of the polyaniline particles obtained from a single belt, by sampling a total of nine samples, 3 positions in the width direction×3 positions in the peripheral direction, and measuring the length by the method described above. Results are summarized in Tables 7 and 8.

The kind of the polyamic acid, the solid weight ratio of the polyaniline, polyamic acid and filler, and the kind and the content (vol %) of the filler in the coating liquid used in the production process for the intermediate transfer belts I to N are also shown in Tables 7 and 8.

The "yield", "electrical properties", "surface physical properties", and "quality of transferred image" of the intermediate transfer belts I to N are also determined in a manner similar to the intermediate transfer belt A, and further, the micro-hardness as the "surface physical properties", "expansion tendency", "tensile strength", and "walk distance during image formation" thereof are also evaluated by the following methods. Evaluation results are summarized in the following Tables 7 and 8.

Evaluation of Surface Physical Properties (Measurement of Micro-Hardness)

The micro-hardness is determined as follows. Three intermediate transfer belts are arbitrarily picked up and samples are prepared according to the method above using arbitrary three points of each of three intermediate transfer belts. With respect to each sample, arbitrary 10 points are measured. The average of three samples are designated as the micro-hardness of the belt. Tables 7 and 8 show the results of the belt worst in evaluation.

The evaluation criteria for the micro-hardness shown in Tables 7 and 8 are as follows:

A: 200 or less (favorable)

B: More than 20° and 25° or less (satisfactory)

C: More than 25° and 300 or less (demanding some adjustment of the system)

D: 300 or more (practically unusable) (unsatisfactory)

Evaluation of Belt Expansion Tendency (Measurement of Humidity Expansion Coefficient)

The humidity expansion coefficient is determined as follows. Three intermediate transfer belts are arbitrarily picked up. With respect to each of the three intermediate transfer belts, a sample is prepared using arbitrary one point, and is measured according to the method described above. Tables 7 and 8 show the results of the belt worst in evaluation.

The evaluation criteria for the humidity expansion coefficient shown in Tables 7 and 8 are as follows:

A: 30 ppm/% RH or less (favorable)

B: More than 30 ppm/% RH and 45 ppm/% RH or less (satisfactory)

C: More than 45 ppm/% RH and 60 ppm/% RH or less (demanding some adjustment of the system)

D: 60 ppm/% RH or more (unsatisfactory)

(Measurement of Thermal Expansion Coefficient)

The thermal expansion coefficient is determined as follows. Three intermediate transfer belts are arbitrarily picked up. With respect to each of the three intermediate transfer belts, a sample is prepared by using arbitrary one point, and is measured according to the method described above. Tables 7 and 8 show the results of the belt worst in evaluation.

The evaluation criteria for the thermal expansion coefficient shown in Tables 7 and 8 are as follows:

A: 30 ppm/K or less (favorable)

B: More than 30 ppm/K and 45 ppm/K or less (satisfactory)

C: More than 45 ppm/K and 60 ppm/K or less (demanding some adjustment of the system)

D: 60 ppm/K or more (unsatisfactory)

Evaluation of Belt Tensile Strength (Measurement of Tensile Elastic Modulus)

The tensile elastic modulus is determined as follows. Three intermediate transfer belts are arbitrarily picked up. With respect to each of three intermediate transfer belts, 10 samples are prepared using arbitrary picked up one point, and are measured according to the method described above. The intermediate transfer belt measured is preconditioned in an environment of 28° C. and 85% RH (A zone) or in an environment of 22° C. and 55% RH environment (B zone) for 24 hours or longer. Tables 7 and 8 show the averages.

The evaluation criteria for the humidity expansion coefficient shown in Tables 7 and 8 are as follows:

A: 3,500 MPa or more (favorable)

B: Less than 3,500 MPa and 2,500 MPa or more (satisfactory)

C: Less than 2,500 MPa and 2,300 MPa or more (demanding some adjustment of the system)

D: Less than 2,300 MPa (unsatisfactory)

Evaluation of the Walk Distance During Image Formation

The walk distance during image formation is evaluated by placing each of three intermediate transfer belts arbitrarily picked up in COLOR DOCUTECH 60 manufactured by Fuji Xerox Co., Ltd., a device similar to the image-forming apparatus shown in FIG. 1.

The walk distance means a distance of a belt still moving even when the drive of the intermediate transfer belt is controlled by the drive-controlling method described in Japanese Patent No. 3632731 (active steering method).

A typical method of determining the walk distance is described below:

First, the COLOR DOCUTECH 60 is placed in an environment of 22° C. and 55% RH. Separately, an intermediate transfer belt is left and conditioned in an environment of 22° C. and 55% RH for 24 hours or more. Then, the conditioned intermediate transfer belt is placed in the COLOR DOCUTECH 60, and the apparatus is turned on.

The data on the edge shape on the installed intermediate transfer belt are obtained and stored in a memory device.

Then, an image is printed on 20 sheets of A3 paper. At this time, the intermediate transfer belt rotates five times. The edge shape data of the intermediate transfer belt during each printing are also collected.

The edge shape data obtained during each printing is evaluated whether it is acceptable by comparison with the edge shape data stored in the memory device, and if not acceptable, the edge shape data stored in the memory device is updated with the edge shape data newly observed.

The walk distance is calculated from the edge shape data at each measurement point stored in the memory device and the edge shape data measured at each measurement point.

Separately, the intermediate transfer belt is placed in the COLOR DOCUTECH 60, and the apparatus is turned on and left as it is for 60 minutes.

An image is then printed on 20 sheets of A3 paper, and the walk distance is determined similarly as described above. Deformation of the edge shape, if it occurs during storage for 60 minutes, leads to elongation of the walk distance.

A walk distance of 22.4 μm or less at each edge shape-measuring point is ranked A, and that of more than 22.4 μm is ranked C (practically unusable).

The methods of measuring the edge shape and of controlling, i.e., comparing and revising, the edge shape values described in Japanese Patent No. 3632731 are used.

Separately, after the COLOR DOCUTECH 60 and the intermediate transfer belt are preconditioned under an environment of 28° C. and 85% RH, the walk distance is also determined similarly. The results are also shown in Tables 7 and 8.

The walk distances in zone A in Tables 7 and 8 are walk distances when the COLOR DOCUTECH 60 is placed and the intermediate transfer belt is left and conditioned in an environment of 28° C. and 85% RH. Similarly, the walk distances in zone B are walk distances when the COLOR DOCUTECH 60 is placed and the intermediate transfer belt is left and conditioned in an environment of 22° C. and 55% RH.

TABLE 7

| Table 7 | | Example D1 Intermediate transfer belt I | Example D2 Intermediate transfer belt J | Example D3 Intermediate transfer belt K | Example D4 Intermediate transfer belt L | Example D5 Intermediate transfer belt M | Example D6 Intermediate transfer belt N |
|---|---|---|---|---|---|---|---|
| Composition of coating liquid | Kind of polyamic acid | ODA:BPDA = 1.0:1.0 | ODA:BPDA = 1.0:1.0 | ODA:BPDA:PMDA = 1.0:0.8:0.2 | ODA:BPDA:PMDA = 1.0:0.8:0.2 | ODA:BPDA:PMDA = 1.0:0.55:0.45 | ODA:BPDA:PMDA = 1.0:0.55:0.45 |
| | Solid weight ratio (PAn: PAA: filler) | 10.8:79.2:10.0 | 10.1:79.9:10.0 | 10.8:79.2:10.0 | 10.1:74.9:15.0 | 10.1:74.9:15.0 | 10.1:74.9:15.0 |
| | Kind of filler | Tin oxide | Titanium oxide | Tin oxide | Tin oxide | Tin oxide | Titanium oxide |
| | Filler content (vol %) | 2.3 | 3.2 | 2.3 | 3.2 | 3.2 | 3.2 |

TABLE 7-continued

| Table 7 | | Example D1 Intermediate transfer belt I | Example D2 Intermediate transfer belt J | Example D3 Intermediate transfer belt K | Example D4 Intermediate transfer belt L | Example D5 Intermediate transfer belt M | Example D6 Intermediate transfer belt N |
|---|---|---|---|---|---|---|---|
| Intermediate transfer belt | Absolute maximum length of largest polyaniline particle (μm) | 6.6 | 6.6 | 6.6 | 6.6 | 6.6 | 6.6 |
| | 50 and 90 percentile particle diameters (μm) | 1.5, 2.5 | 1.5, 2.5 | 2.5, 2.5 | 1.5, 2.5 | 2.5, 2.5 | 1.5, 2.5 |
| | 90 percentile particle diameter/50 percentile particle diameter | 1.67 | 1.67 | 1.67 | 1.67 | 1.67 | 1.67 |
| | Absolute maximum length of the largest filler particle (μm) | 2.4 | 2.0 | 2.4 | 2.4 | 2.4 | 2.0 |

TABLE 8

| Table 8 | | Example D1 Intermediate transfer belt I | | Example D2 Intermediate transfer belt J | | Example D3 Intermediate transfer belt K | |
|---|---|---|---|---|---|---|---|
| Yield | Number of samples with acceptable appearance (out of 20 samples) | A | 19 | A | 19 | A | 19 |
| Electrical properties | Surface resistivity (logΩ/□) | A | 12.0 ± 0.1 | A | 12.2 ± 0.1 | A | 12.0 ± 0.1 |
| | Volume resistivity (logΩ cm) | A | 11.6 ± 0.1 | A | 11.8 ± 0.1 | A | 11.6 ± 0.1 |
| Surface physical properties | Surface roughness Ra (μm) | A | 0.035-0.044 | A | 0.039-0.047 | A | 0.034-0.043 |
| | Micro-glossiness 75° (gloss units) | A | 105-110 | A | 103-107 | A | 108-114 |
| | Micro-hardness (mN/μm) | B | 22 | B | 22 | B | 21 |
| | Sharpness (reflectivity of grid pattern) | A | Very small grid deformation and definite thin grid line | A | Very small grid deformation and definite thin grid line | A | Very small grid deformation and definite thin grid line |
| Expansion | Humidity expansion coefficient (ppm/% RH) | B | 31 | B | 34 | B | 36 |
| | Thermal expansion coefficient (ppm/K) | B | 31 | B | 33 | B | 37 |
| Tensile strength | Tensile elastic modulus in zone A (MPa) | B | 3090 | B | 2990 | B | 2970 |
| | Tensile elastic modulus in zone B (MPa) | B | 3110 | B | 3050 | B | 2980 |

TABLE 8-continued

| | | | | | |
|---|---|---|---|---|---|
| Walk distance during image formation | A zone | Power on → printing | A | A | A |
| | | Storage for 60 minutes → printing | A | A | A |
| | B zone | Power on → printing | A | A | A |
| | | Storage for 60 minutes → printing | A | A | A |
| Evaluation of transferred image | Graininess | | A | A | A |
| | White deletion (M30% H/T) | | A | A | A |
| | Cleaning defect | | A | A | A |
| Overall evaluation | | | A | A | A |

| Table 8 | | | Example D4 Intermediate transfer belt L | | Example D5 Intermediate transfer belt M | | Example D6 Intermediate transfer belt N |
|---|---|---|---|---|---|---|---|
| Yield | Number of samples with acceptable appearance (out of 20 samples) | A | 19 | A | 19 | A | 19 |
| Electrical properties | Surface resistivity (logΩ/□) | A | 12.0 ± 0.1 | A | 12.0 ± 0.1 | A | 12.2 ± 0.1 |
| | Volume resistivity (logΩ cm) | A | 11.6 ± 0.1 | A | 11.6 ± 0.1 | A | 11.8 ± 0.1 |
| Surface physical properties | Surface roughness Ra (μm) | A | 0.041-0.048 | A | 0.040-0.048 | A | 0.033-0.042 |
| | Micro-glossiness 75° (gloss units) | A | 101-105 | A | 113-117 | A | 107-111 |
| | Micro-hardness (mN/μm) | B | 22 | B | 21 | B | 21 |
| | Sharpness (reflectivity of grid pattern) | A | Very small grid deformation and definite thin grid line | A | Very small grid deformation and definite thin grid line | A | Very small grid deformation and definite thin grid line |
| Expansion | Humidity expansion coefficient (ppm/% RH) | B | 33 | B | 37 | B | 38 |
| | Thermal expansion coefficient (ppm/K) | B | 33 | B | 38 | B | 38 |
| Tensile strength | Tensile elastic modulus in zone A (MPa) | B | 3130 | B | 2970 | B | 2980 |
| | Tensile elastic modulus in zone B (MPa) | B | 3200 | B | 3010 | B | 3010 |
| Walk distance during image formation | A zone Power on → printing | | A | | A | | A |
| | Storage for 60 minutes → printing | | A | | A | | A |
| | B zone Power on → printing | | A | | A | | A |
| | Storage for 60 minutes → printing | | A | | A | | A |

TABLE 8-continued

| | | | | |
|---|---|---|---|---|
| Evaluation of transferred image | Graininess | A | A | A |
| | White deletion (M30% H/T) | A | A | A |
| | Cleaning defect | A | A | A |
| Overall evaluation | | A | A | A |

The foregoing description of the embodiments of an aspect of the invention has been provided for the purpose of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practice applications, thereby enabling others skilled in the art to understand invention for various embodiments and with the various modifications as are suited to the particular use contemplated. It is intended that the scope of the invention be defined by the following claims and their equivalents.

What is claimed is:

1. An image-forming apparatus, comprising:

an image holding member;

a charging device that charges the image holding member;

an electrostatic latent image-forming device that exposes a surface of the charged image holding member to light to form an electrostatic latent image;

a developing device that develops the electrostatic latent image formed on the image holding member with toner into a toner image;

an intermediate transfer body to which the toner image formed on the image holding member is transferred;

a primary transfer device that transfers the toner image formed on the image holding member onto the intermediate transfer body; and a secondary transfer device that transfers the toner image transferred on the intermediate transfer body onto a recording medium, the intermediate transfer body comprising a resin layer containing polyaniline particles, and the 50 percentile particle diameter (number basis) of the toner being at least twice as large as the 50 percentile particle diameter (number basis) of the polyaniline particles.

2. The image-forming apparatus according to claim 1, wherein the 10 percentile particle diameter (number basis) of the toner is greater than the 90 percentile particle diameter (number basis) of the polyaniline particles.

3. The image-forming apparatus according to claim 1, wherein the difference between the 10 percentile particle diameter (number basis) of the toner and the 90 percentile particle diameter (number basis) of the polyaniline particles is about 0.3 μm or more.

4. The image-forming apparatus according to claim 1, wherein the 50 percentile particle diameter (number basis) of the polyaniline particles is in the range of about 0.05 μm to about 3.0 μm, and the 90 percentile particle diameter (number basis) of the polyaniline particles is equal to or greater than the 50 percentile particle diameter (number basis) of the polyaniline particles but not greater than twice the 50 percentile particle diameter (number basis) of the polyaniline particles.

5. The image-forming apparatus according to claim 1, wherein the 50 percentile particle diameter (number basis) of the toner is at least three times as large as the 50 percentile particle diameter (number basis) of the polyaniline particles.

6. The image-forming apparatus according to claim 1, wherein the absolute maximum length of the largest particle among the polyaniline particles is about 10.0 μm or less.

7. The image-forming apparatus according to claim 1, wherein the absolute maximum length of the largest particle among the polyaniline particles is about 7.0 μm or less.

8. The image-forming apparatus according to claim 1, wherein the resin layer further contains a filler, and the absolute maximum length (a) of the largest particle among the polyaniline particles and the absolute maximum length (b) of the largest filler particle satisfy the requirement represented by the following Formula (1):

$$\text{About } 10.0\ \mu\text{m} \geqq \text{Absolute maximum length (a)} > \text{Absolute maximum length (b)} \geqq \text{About } 0.1\ \mu\text{m}. \qquad \text{Formula (1)}$$

9. The image-forming apparatus according to claim 1, wherein the surface roughness Ra of the intermediate transfer body is in the range of about 0.010 μm to about 0.050 μm.

10. The image-forming apparatus according to claim 1, wherein the intermediate transfer body has a micro-glossiness at an incident angle of about 75° to the transfer face in the range of about 95 gloss units to about 120 gloss units.

11. The image-forming apparatus according to claim 1, wherein the intermediate transfer body further comprises a dopant that makes the polyaniline particles conductive.

12. The image-forming apparatus according to claim 1, wherein the polyaniline particles are particles of self-doped polyaniline.

* * * * *